US007578574B2

(12) United States Patent
Suzuki

(10) Patent No.: US 7,578,574 B2
(45) Date of Patent: Aug. 25, 2009

(54) INK-JET RECORDING APPARATUS

(75) Inventor: Katsuaki Suzuki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 635 days.

(21) Appl. No.: 10/998,088

(22) Filed: Nov. 29, 2004

(65) Prior Publication Data

US 2005/0116972 A1 Jun. 2, 2005

(30) Foreign Application Priority Data

Nov. 27, 2003 (JP) ..... 2003-396635

(51) Int. Cl.
*B41J 2/165* (2006.01)
*B41J 2/015* (2006.01)

(52) U.S. Cl. ..... 347/35; 347/20

(58) Field of Classification Search ..... 347/35, 347/9, 13, 42, 20
See application file for complete search history.

(56) References Cited

U.S. PATENT DOCUMENTS 6,022,104 A * 2/2000 Lin et al. ..... 347/102
6,419,338 B1 * 7/2002 Ikeda ..... 347/14
6,672,705 B2 1/2004 Kitahara et al.
2001/0020962 A1 * 9/2001 Kanaya et al. ..... 347/24
2002/0054185 A1 * 5/2002 Kinoshita ..... 347/35
2002/0191039 A1 * 12/2002 Minowa et al. ..... 347/7
2004/0041862 A1 * 3/2004 Nakagawa et al. ..... 347/9
2004/0090487 A1 * 5/2004 Kanemura ..... 347/35
2004/0113973 A1 * 6/2004 Nakashima ..... 347/35
2004/0246324 A1 12/2004 Nakashima

FOREIGN PATENT DOCUMENTS

EP 0 968 826 A2 1/2000
JP P2000-127359 A 5/2000
JP 2000-272110 10/2000
JP P2000-272110 A 10/2000
JP P2001-105628 4/2001
JP A-2001-277553 10/2001
JP P2001-347692 A 12/2001
JP A-2002-103598 4/2002
WO WO 03/076319 A1 9/2003

* cited by examiner

*Primary Examiner*—Julian D Huffman
*Assistant Examiner*—Jason S Uhlenhake
(74) *Attorney, Agent, or Firm*—Oliff & Berridge, PLC

(57) ABSTRACT

An ink-jet image forming apparatus includes an ink-jet head having at least a first nozzle portion and a second nozzle portion, where each nozzle portion may independently perform preliminary ink ejection is provided.

57 Claims, 16 Drawing Sheets

INK-JET RECORDING APPARATUS

INCORPORATION BY REFERENCE

This application claims priority from JP 2003-396635, filed Nov. 27, 2003, the subject matter of which is incorporated herein in its entirety by reference thereto.

BACKGROUND

The invention relates to an ink-jet recording apparatus that forms an image on a recording medium by ejecting ink droplets onto the recording medium.

Ink-jet image forming devices, e.g., printers, generally employ at least one ink-jet head which distributes ink supplied from an ink tank to a plurality of pressure chambers contained therein. The ink-jet head selectively applies a pulsed pressure to the pressure chambers and the pressure causes nozzles of the ink-jet head to eject ink droplets onto a recording medium (e.g., paper). In the ink-jet head, ink channels provide ink to the nozzles. The ink channels are extremely narrow, and thus, the ink channels may become clogged with ink. Clogging or blockage of the ink channel is more likely to occur in ink channels that are associated with nozzles which do not regularly eject ink because when ink is maintained in an ink channel, the viscosity of the maintained ink increases. In order to reduce, and preferably prevent, clogging of the ink channels, preliminary ink ejection is performed to eject ink from the nozzles before a printing operation is started, regardless of whether the nozzles are to eject ink during the printing operation.

In serial-type ink-jet printers wherein the ink-jet heads move in a direction substantially perpendicular to a conveying direction of a recording medium, methods for performing preliminary ink ejection are known. For example, in serial-type ink-jet printers, preliminary ink ejection may be performed after the ink-jet heads are moved to a position where the ink-jet heads are not opposite to a conveyor belt that conveys the recording medium. However, line-type ink-jet printers which have a plurality of ink-jet heads arranged such that the longer sides of each ink-jet head extend along a direction substantially perpendicular to a recording medium conveying direction, have become a focus of attention for high-speed printing. In line-type ink-jet printers, the size of the ink-jet printer becomes large if it is designed such that, for preliminary ink ejection, either the ink-jet heads or a conveyor belt is moved so as not be opposite to the other. Japanese Laid-Open Patent Publication No. 2000-272110 discloses an approach for preliminarily ink ejection for a line-type ink-jet printer, in which ink is ejected during preliminary ink ejection onto a preliminary ejection area provided on a conveyor belt.

SUMMARY

In the line-type ink-jet printer disclosed in Japanese Laid-Open Patent Publication No. 2000-272110, during preliminary ink ejection all the nozzles included in a single ink-jet head perform preliminary ink ejection at the same time (i.e., all the nozzles of the ink-jet head perform preliminary ink ejection simultaneously). Thus, none of the nozzles of the ink-jet head may perform ink ejection for printing (i.e., ejecting ink onto the recording medium) when the ink-jet head is performing preliminary ink ejection (i.e., ejecting ink onto the preliminary ejection area). Further, the width of the preliminary ejection area needs to be wider than the width of the ink-jet head at least by an amount which the conveyor belt will travel during the time the ink-jet head performs preliminary ink ejection. To allow for preliminary ink ejection, as disclosed by Japanese Laid-Open Patent Publication No. 2000-272110, the circumference of the conveyor belt, which is generally preferred to be a minimum distance for placing a recording medium, having a predetermined length thereon, during the printing process, needs to be increased at least by an amount equal to the width of the ink-jet head having the largest width (i.e., the side extending along the recording medium conveying direction) and the distance that the conveyor belt will travel while that ink-jet head is performing preliminary ink ejection and thus, the circumference of the conveyor belt is increased. As the circumference of the conveyor belt becomes longer, a distance between conveyor rollers, around which the conveyor belt is wound, needs to be elongated. Thus, in an ink-jet printer accommodating such a preliminary ink ejection area for all the nozzles of the ink-jet head becomes large in size.

In addition, when the circumference of the conveyor belt is increased and the conveying speed of a recording medium is not changed, the number of recording media which can be printed in unit time, i.e., throughput of the ink-jet printer, is reduced. Further, while the conveying speed of the recording medium may be increased to maintain and/or increase the throughput, the image quality may be sacrificed as a result.

One aspect of this invention provides an ink-jet recording apparatus, including a preliminary ink ejecting area, wherein printing throughput is increased and a size of a conveying device is reduced as compared with the printing throughput and the size of a conveying device according to the apparatus discussed above in which all the nozzles of a print head undergo preliminary ink ejection substantially simultaneously.

According to another aspect of the invention, an ink-jet image forming apparatus with an ink-jet head having at least a first nozzle portion and a second nozzle portion, where each nozzle portion may independently perform preliminary ink ejection is provided. During preliminary ink ejection an ink-jet head ejects ink onto a surface of a preliminary ink ejecting section. The image forming apparatus is equipped with a moving member, the moving member supports a recording medium thereon and includes a preliminary ink ejection section. The moving member moves a recording medium and a preliminary ink ejection section relative to an ink-jet head. The ink-jet head has an ink ejection controller which controls an ink-jet head such that when the ink ejection controller determines that a preliminary ink ejection section of a moving member is moved to substantially overlap a first nozzle portion, the first nozzle portion of the ink-jet head performs preliminary ink ejection and when the preliminary ink ejection section is subsequently moved to substantially overlap a second nozzle portion, the second nozzle portion performs preliminary ink ejection.

According to another aspect of the invention, a method for reducing clogging of ink in an ink-jet head comprising at least a first nozzle portion and a second nozzle portion is provided. The method comprises determining when a preliminary ink ejection section is moved to substantially overlap a first nozzle portion of an ink-jet head, ejecting ink from the first nozzle portion of the ink-jet head onto a preliminary ink ejection surface when it is determined that the first nozzle portion is substantially overlapping the preliminary ink ejection section, where the preliminary ink ejection surface is a surface other than a surface of a recording medium on which an image is to be formed, and subsequently ejecting ink from a second nozzle portion of the ink-jet head onto the preliminary ink ejection surface when the second nozzle portion is moved such that the second nozzle portion substantially overlaps the preliminary ink ejection section.

According to another aspect of the invention, an ink-jet image forming apparatus including ink ejecting means including at least a first ink ejection portion and a second ink ejection portion for ejecting ink from a single ink storage means, moving means for moving a preliminary ink ejection surface and a recording medium relative to the ink ejecting means, and determining means for determining when each of the first and second ink ejection portions substantially overlaps the preliminary ink ejection surface is provided. Each of a first ink ejection portion and a second ink ejection portion performs preliminary ink ejection onto a preliminary ink ejection surface and each of the first and second ink ejecting portions performs image forming ink ejection onto a surface of a recording medium on which an image is to be formed. A preliminary ink ejection surface is a surface other than a surface of the recording medium on which an image is to be formed. When a first ink ejection portion substantially overlaps the preliminary ink ejection surface, the first ink ejection portion performs preliminary ink ejection and subsequently, when a second ink ejection portion substantially overlaps the preliminary ink ejection surface, the second ink ejection portion performs preliminary ink ejection.

These and other optional features and possible advantages of various aspects of this invention are described in, or are apparent from, the following detailed description of exemplary embodiments of systems and methods which implement this invention.

BRIEF DESCRIPTION OF THE DRAWINGS

Exemplary embodiments of the invention will be described in detail with reference to the following figures wherein.

DETAILED DESCRIPTION OF EXEMPLARY EMBODIMENTS

Exemplary embodiments of the invention will be described with reference to the accompanying drawings. Throughout the following description, numerous specific structures/steps are set forth in order to provide a thorough understanding of the invention. The invention can be practiced without utilizing all of these specific structures/steps. In other instances, well known elements have not been shown or described in detail, so that emphasis can be focused on the invention.

Figure 1:
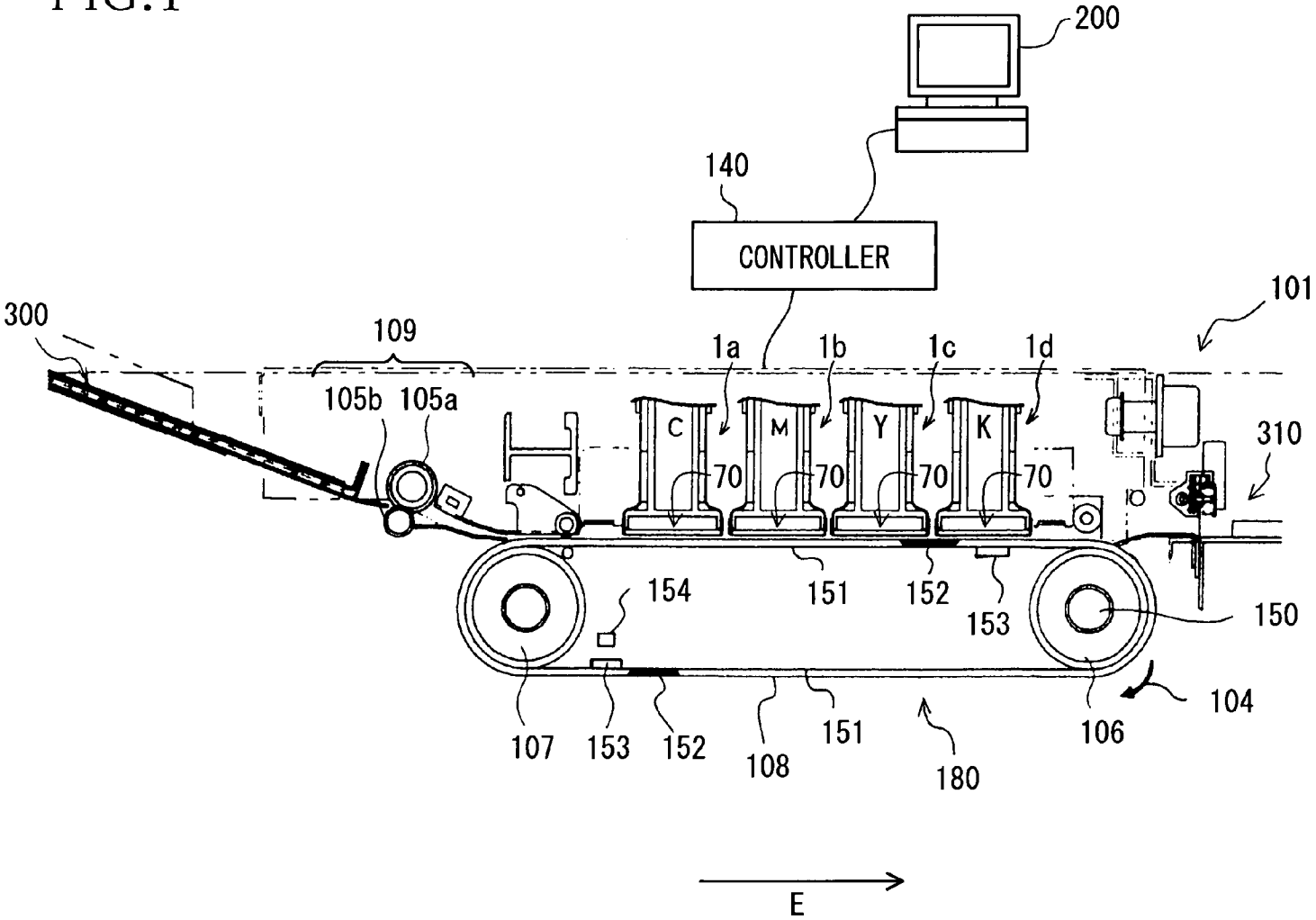
FIG. 1 is a schematic showing an ink-jet printer employing a combination of one or more aspects of the invention.

An exemplary ink-jet printer 101 is illustrated in FIG. 1. The exemplary ink-jet printer 101 is a color ink-jet printer having four ink-jet heads 1*a*, 1*b*, 1*c*, 1*d*. As shown in FIG. 1, the exemplary ink-jet printer 101 includes a sheet feed portion 300 on the left side of the drawing and a sheet discharge portion 310 on the right side of the drawing. The ink-jet printer 101 further includes a controller 140 that controls the ink-jet printer 101. A personal computer (PC) 200 is connected with the controller 140 of the ink-jet printer 101. A user can control the ink-jet printer 101 via, for example, driver software running on the PC 200.

In the exemplary ink-jet printer 101, a sheet conveying path is provided so that a sheet (i.e., a recording medium) P is conveyed from the sheet feed portion 300 to the sheet discharge portion 310. A direction extending from the sheet feed portion 300 to the sheet discharge portion 310 (a direction indicated by an arrow E in FIG. 1) refers to a sheet conveying direction. An upstream portion and a downstream portion, relative to each other, along the sheet conveying direction E may hereinafter be simply referred to as upstream and downstream, respectively. A pair of feed rollers 105*a*, 105*b* are provided immediately downstream from the sheet feed portion 300 in the sheet conveying direction E. The feed rollers 105*a*, 105*b* pinch one sheet P from a stack of papers or other recording media provided on the sheet feed portion 300 and convey the pinched sheet P so as to place the sheet P on the conveyor belt 108. The sheets P of the recording medium are conveyed one at a time to the conveyor belt 108. The pair of feed rollers 105*a*, 105*b* are also referred to a loading device 109. The loading device 109 includes a loading motor 155 (see FIG. 7) that drives the loading device 109. In the exemplary ink-jet printer 101 illustrated in FIG. 1, the pair of feed rollers 105*a*, 105*b* convey the sheet P from, for example, the left side to the right side of the ink-jet printer 101 along a sheet conveying path provided therein. In substantially the middle of the sheet conveying path, a conveying device 180 is provided. The exemplary conveying device 180 includes two belt rollers 106, 107, the endless (i.e., closed surface) conveyor belt (a medium holding body) 108, which runs between the belt rollers 106, 107, a conveyor motor 150, which drives the belt rollers 106, 107, and a flushing area sensor 154.

Figure 6:
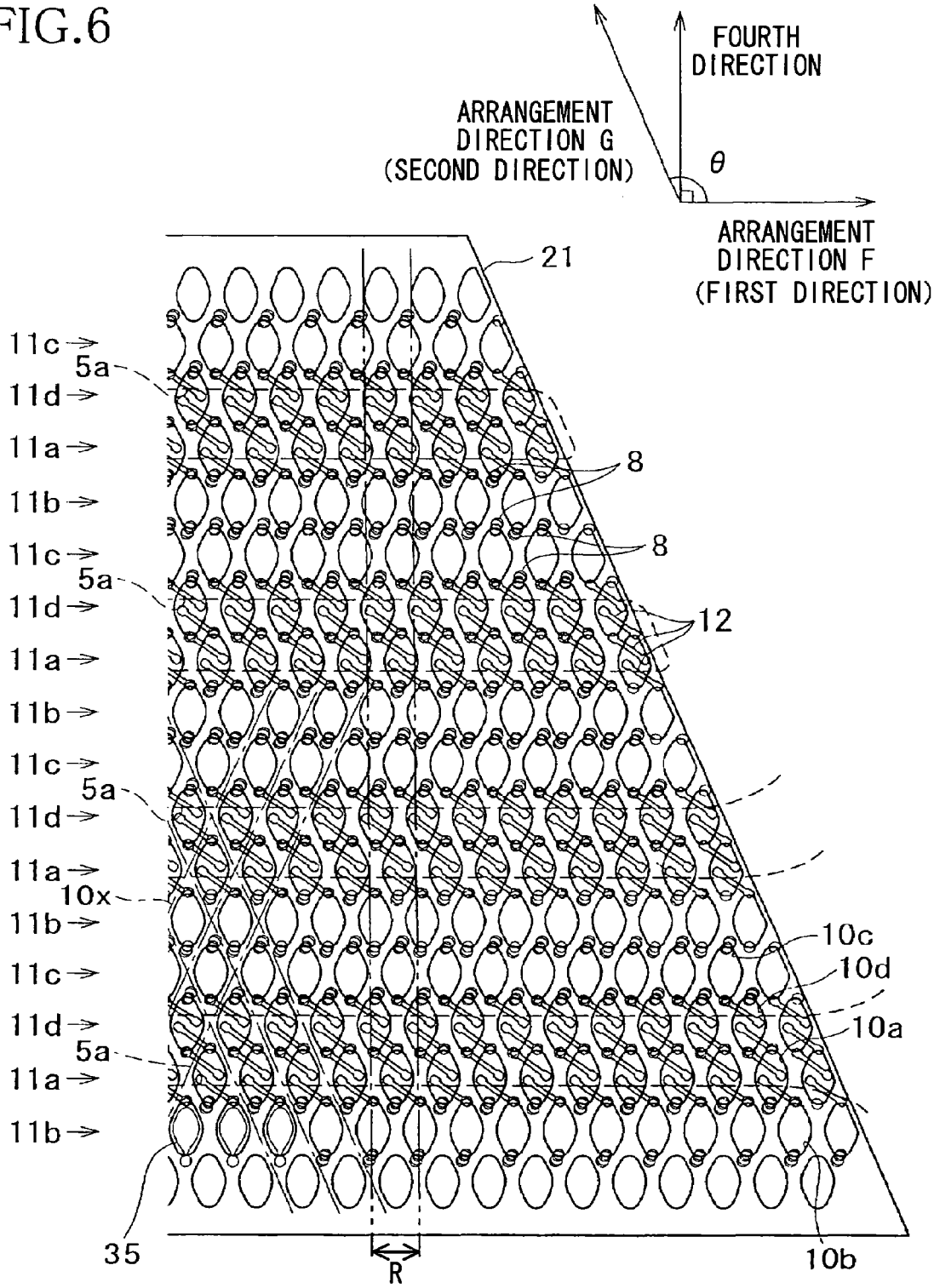
FIG. 6 is an enlarged view of the area enclosed with a dashed line in FIG. 5.

The exemplary conveyor belt 108 includes two printing areas 151, two flushing areas (preliminary ink ejection areas) 152, and two markings 153. The printing areas 151 are where portions of the sheets P, which have been placed on the conveying device 108 by the loading device 109, are subjected to the printing process. That is, printing, on the sheets P, is performed when the portions of the sheets P on the printing areas 151 are located at a position substantially opposite to the ink-jet heads 1*a* to 1*d*. The flushing areas 152 are where flushing (i.e., preliminary ink ejection) is performed, and flushing is performed when the flushing areas 152 are located at a position substantially opposite to the ink-jet heads 1*a* to 1*d*. The sheets P (i.e., recording media) on which an image is to be printed are not on the flushing areas of the conveying device 108 when flushing is performed. However, the sheets P (i.e., recording media may be on the flushing areas 152 when printing is being performed. Flushing is an operation during which an extremely small amount of ink is ejected from the ink-jet heads 1*a* to 1*d* before ink is ejected therefrom for printing, in order to achieve improved/excellent ink ejection during printing operations. The amount of ink ejected during a flushing operation is based on an amount of ink that needs to be ejected from the nozzles in order to reduce, and preferably prevent, clogging of ink inside the channels and nozzles. The width of the flushing areas 152 in various embodiments of one or more aspects of the invention is generally based on a maximum width (i.e., the side extending along the recording medium conveying direction) of any nozzle portion of a single ink-jet head which will undergo preliminary ink ejection substantially simultaneously may have. Generally, for example, the width of the flushing areas 152, at a minimum, will be a distance substantially equal to the maximum width that any nozzle portion may have plus the distance that the conveyor belt will travel during flushing of that nozzle portion with the maximum width. In the exemplary embodiments of one or more aspects of the invention described herein, the exemplary nozzle portion(s) each include a single line of nozzles (i.e., nozzle line) or a plurality nozzle lines. A nozzle line may comprise, for example, a plurality of nozzles arranged, for example, along a direction crossing the recording medium conveying direction or a plurality of such nozzle lines. More particularly, for example, a nozzle portion may be a nozzle line including nozzles 8 associated with one of pressure chamber rows 11*a* to 11*d* of an actuator 21, as illustrated in FIG. 6, which will be described below. In various embodiments of one or more aspects of the invention, however, a nozzle portion may be, for example, a single nozzle, a plurality of nozzles, a nozzle line, or a plurality of nozzle lines of a single ink-jet head. Further, in various embodiments of one or more aspects of the invention, the circumference of the conveyor belt 108, the distance between and/or the size of the two rollers belt rollers 106, 107 is based on a total of a maximum width that any of the plurality of nozzle portions of a single ink-jet head may have and a distance that the conveyor belt 108 will travel while the nozzle(s) of the nozzle portion having the maximum/greatest width perform preliminary ink ejection. Thus, the circumference of the conveyor belt, the distance between and/or the size of the two rollers belt rollers 106, 107 is to be increased by a smaller amount than needed in known devices in which all the nozzles of an ink-jet head perform preliminary ink ejection substantially simultaneously.

Figure 8:
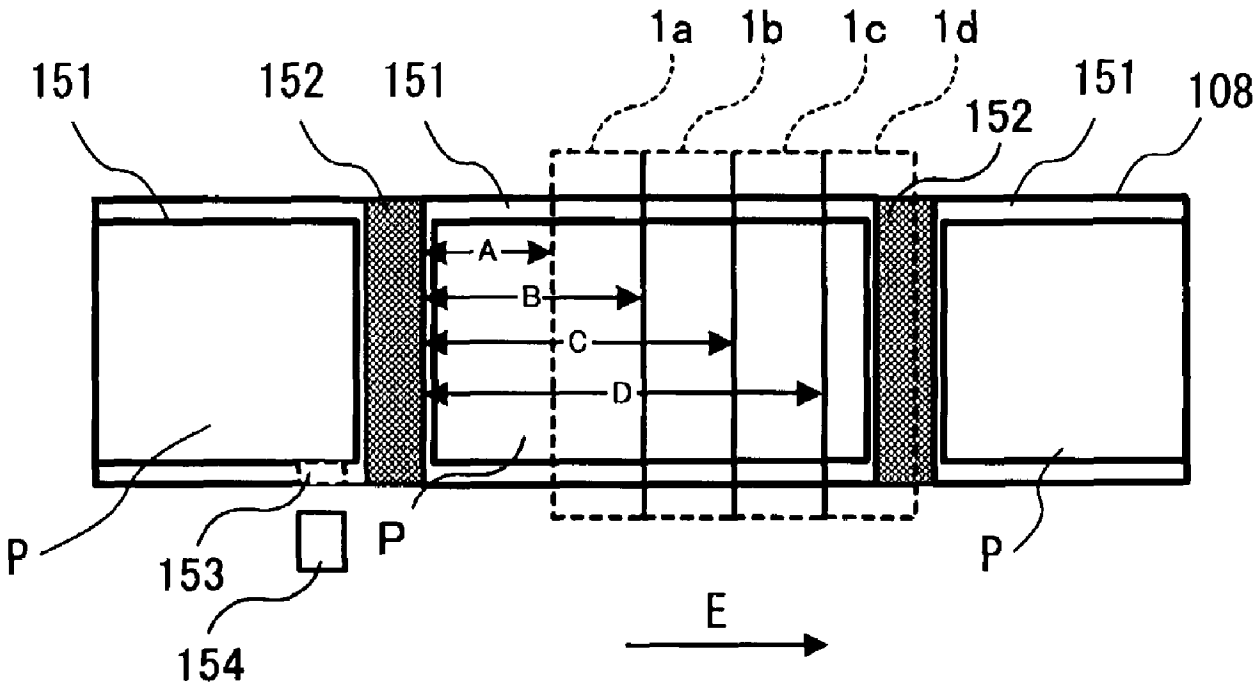
FIG. 8 is a plan view of a conveyor belt employing one or more aspects of the invention.

In the exemplary conveyor belt 108 illustrated in FIGS. 1 and 8, the printing areas 151 and the flushing areas 152 are alternately provided adjacent to each other. The markings 153 are provided downstream from the respective flushing areas 152 in the sheet conveying direction E and are detected by the flushing area sensor 154. The detected result (e.g., detection of a marking 153) may be used to detect the positions of the respective flushing areas 152. Although two markings 153 are shown in FIG. 1, one or more than two markings may be provided in various embodiments of one or more aspects of the invention. Also, in some embodiments, markings 153 and/or the flushing area sensor 154 may not be provided and the respective flushing areas 152 may be detected via other known detection schemes/mechanisms. An outer surface, that is, a conveyor surface of the conveyor belt 108 is generally coated with silicone. The silicone coating on the conveyor belt 108 helps the conveyor belt 108 hold the sheet P on the conveyor surface by its adhesive force and thus, the conveyor belt can convey the sheet P fed by the feed rollers 105*a*, 105*b* along the sheet conveying path in the sheet conveying direction E (i.e. toward the downstream (the right side)), by rotation of the belt roller 106 in a clockwise direction (in a direction indicated by an arrow 104).

Figure 5:
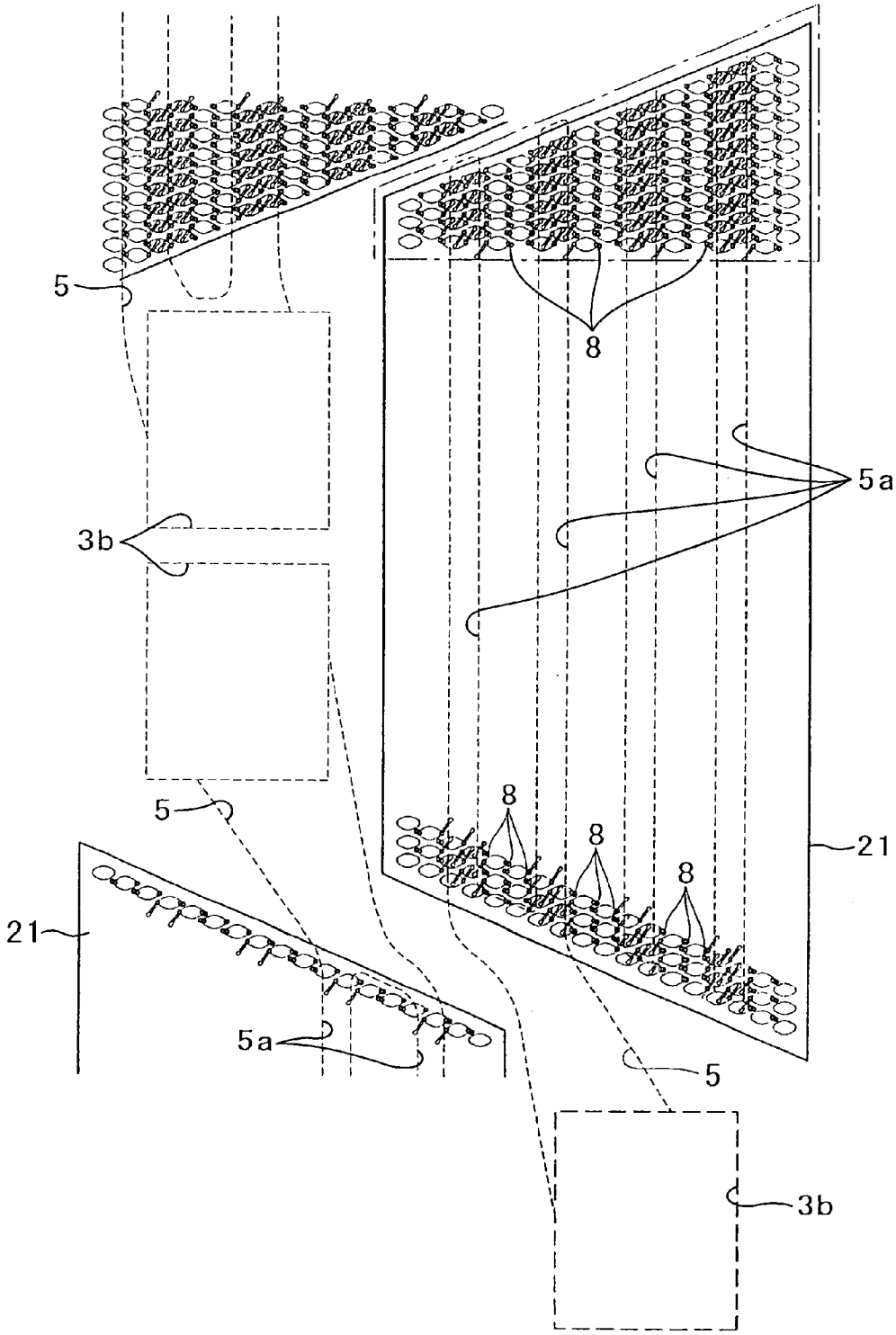
FIG. 5 is an enlarged view of the area enclosed with a dashed line in FIG. 4.

Each of the exemplary ink-jet heads 1*a*, 1*b*, 1*c*, 1*d* includes a head body 70 at its bottom. The exemplary head body 70 has a substantially rectangular shape in cross-section. The ink-jet heads 1*a*, 1*b*, 1*c*, 1*d* are aligned adjacent to each other and such that longer sides of their head bodies 70 extend in a direction substantially perpendicular to the sheet conveying direction E (in a direction perpendicular to the drawing sheet of FIG. 1). That is, the ink-jet printer 101 is a line-type ink-jet printer. The bottom surfaces of the head bodies 70 of the inkjet heads 1*a*, 1*b*, 1*c*, 1*d* face (i.e., are opposed to) an upper surface of the conveyor belt 108 along the sheet conveying path and are provided with nozzle plates including a plurality of nozzles 8 (FIG. 5). The nozzles 8 generally have an extremely small diameter. The ink-jet heads 1*a*, 1*b*, 1*c*, 1*d* eject, for example, cyan (C) ink, magenta (M) ink, yellow (Y) ink, and black (K) colored ink, respectively, from their head bodies 70.

The exemplary head bodies 70 of the ink-jet heads 1*a*, 1*b*, 1*c*, 1*d* are disposed such that a narrow clearance is created between their bottom surfaces and the surface of the conveyor belt 108, and the clearance therebetween serves as the sheet conveying path. As discussed above, the sheet P is conveyed along the sheet conveying path and printing is performed on the sheet P which is sandwiched between the outer surface of the printing areas 151 of the conveyor belt 108 and the bottom surface of the head body 70 of each ink-jet head 1*a* to 1*d*. With such an exemplary structure, ink droplets of each color are ejected from the nozzles 8 onto an upper surface, i.e., a recording surface of the sheet P while the sheet P, which is being conveyed by the conveyor belt 108, passes under the head body 70 of each of the ink-jet heads 1*a* to 1*d*. A desired color image is thereby formed on the sheet P.

Next, the ink-jet heads 1*a*, 1*b*, 1*c*, 1*d* will be described in detail with reference to FIGS. 2 and 3. In the exemplary ink-jet printer 101 described herein, all the ink-jet heads 1*a*, 1*b*, 1*c*, 1*d* have substantially the same structure and function in substantially the same manner, although the ink-jet head 1*a* to 1*d* ejects different colored ink droplets from the nozzles 8. Accordingly, an explanation will be given to the ink-jet head 1*a* only. Further, in some exemplary embodiments of one or more aspects of the invention, all the ink-jet heads may not have the same structure (e.g., the black ink-jet head may be larger). The exemplary ink-jet head 1*a* illustrated in FIGS. 2 and 3 includes the head body 70 having a substantially rectangular shape, when viewed from a top or bottom thereof, and a base block 71. The head body 70 extends in a main scanning direction (FIG. 2) and ejects ink droplets onto sheets P. The base block 71 is disposed above the head body 70 and is provided, for example, with two ink storages 3. The ink storages 3 are associated with the ink channels within which ink to be supplied to the head body 70 flows.

Figure 3:
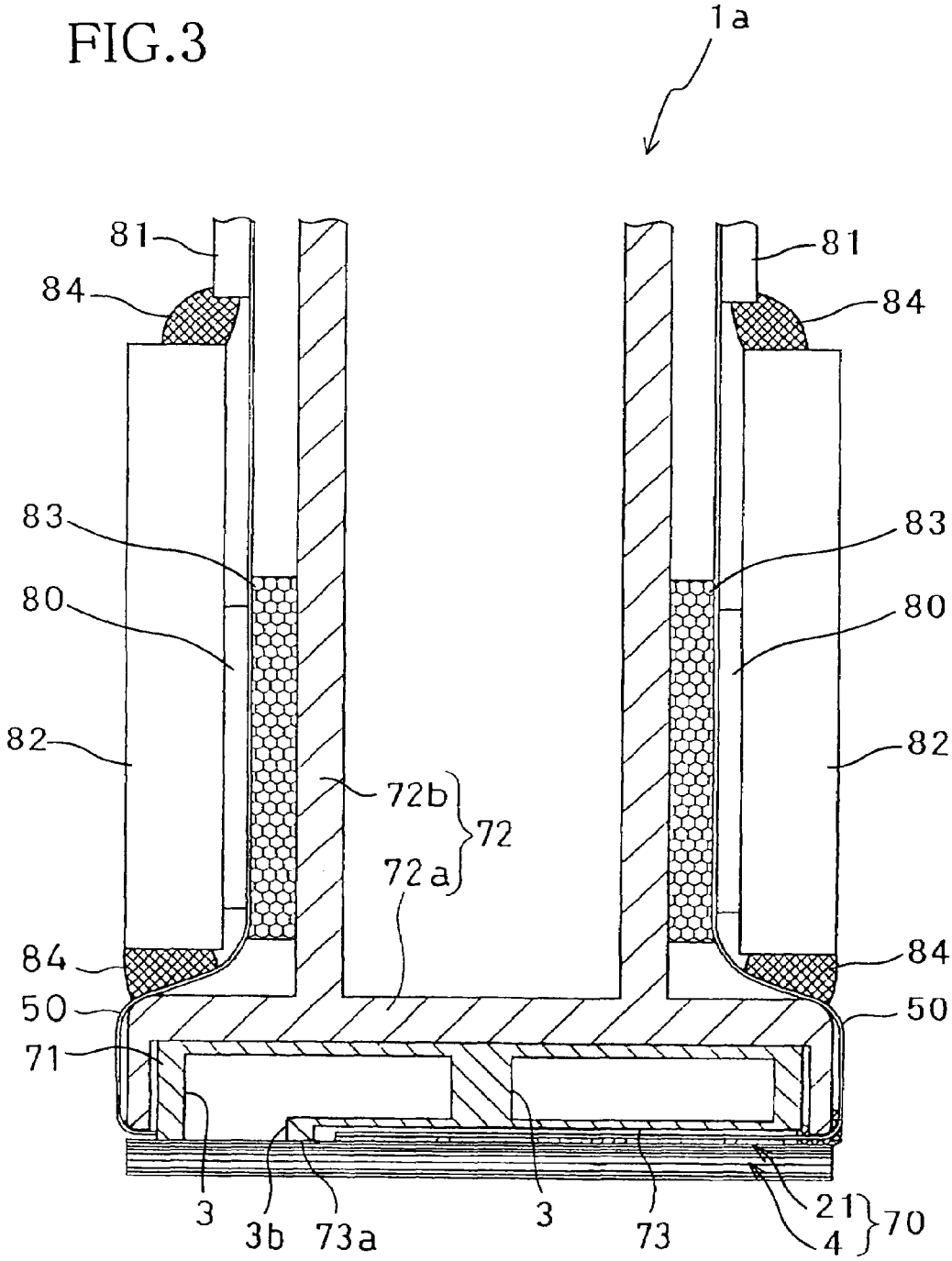
FIG. 3 is a sectional view of the ink-jet head illustrated in FIG. 2, taken along a line III-III of FIG. 2.
Figure 4:
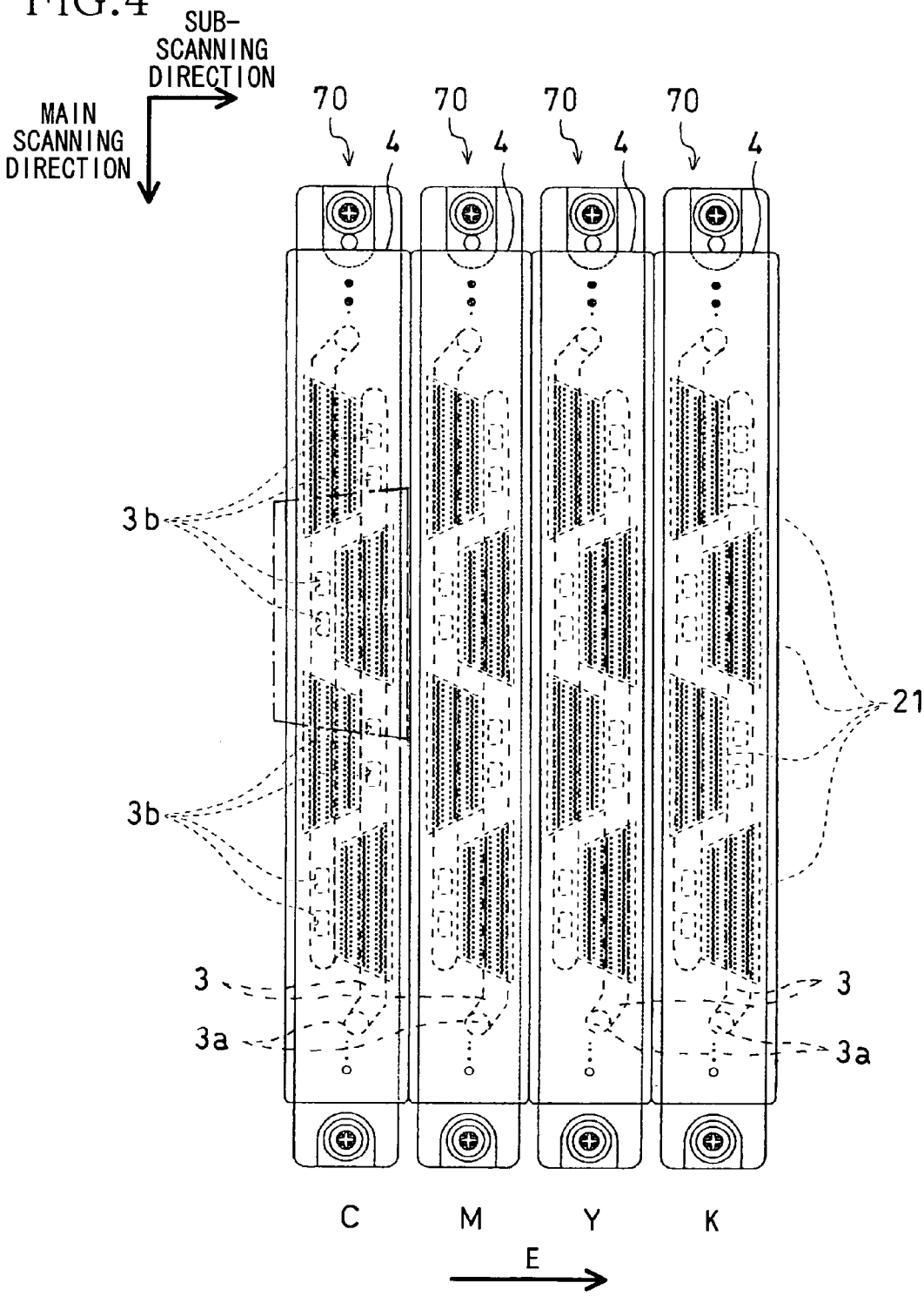
FIG. 4 is a plan view of an exemplary head body included in the ink-jet head illustrated in FIG. 2.

The exemplary head body 70 further includes a channel unit 4 in which the ink channels are provided, and a plurality of actuator units 21 (FIG. 4). The actuator units 21 are adhered to an upper surface of the channel unit 4. The channel unit 4 and the actuator units 21 are formed by laminating a plurality of thin plates one upon the other. A flexible printed circuit (FPC) 50, as a power supply member, is adhered to a top of each actuator unit 21 and is drawn to the right or left side of the ink-jet head 1*a*, in FIG. 3. The base block 71 may be made, for example, of metal (e.g., stainless steel). The ink storages 3, provided in the base block 71, are substantially parallel hollow pipe-like areas with a rectangular-like shape (i.e., substantially rectangular parallelepiped in shape). The ink storages 3 substantially extend in a direction along a longitudinal direction of the base block 71.

As illustrated in FIG. 3, the base block 71 includes, for example, a bottom surface 73 and openings 3*b*. On the bottom surface 73, the vicinity of each opening 3*b* protrudes downward from the surrounding portion. The reference numeral 73*a* designates the vicinity portion. The base block 71 is in contact with the channel unit 4 at the vicinity portion 73*a* of each opening 3*b* of the bottom surface 73. The area of the bottom surface 73 of the base block 71, other than the vicinity portion 73*a* of each opening 3*b*, is separated from the head body 70. The actuator units 21 are provided in the space created between the head body 70 and the base block 71.

The exemplary ink-jet head 1*a* includes a holder 72. The exemplary holder 72 includes a holding portion 72*a* with a bottom that has a recessed portion. In the exemplary ink-jet head illustrated in FIG. 3, the base block 71 is fixedly adhered to the holder 72 in the recessed portion of the holding portion 72*a*. The holder 72 further includes a pair of projecting portions 72*b* which have a substantially flat plate-like shape. The pair of projecting portions 72*b* extend upward from an upper surface of the holding portion 72*a* in a direction substantially perpendicular to a direction that the upper surface of the holding portion 72*a* extends, at a predetermined distance from each other. The flexible printed circuits 50 adhered to the respective actuator units 21 are disposed, for example, such that the elongated portions drawn to the right or left side of the ink-jet head 1*a* extend along the respective surfaces of the projecting portions 72*b* of the holder 72 with elastic members 83 being provided between the projecting portions and the elongated portions of the flexible printed circuits 50. In the exemplary ink-jet head illustrated in FIG. 3, a driver IC 80 is provided on each flexible printed circuit 50 in order to drive the actuator units 21. The flexible printed circuits 50 are electrically connected to the respective driver ICs 80 and the respective actuator units 21, by soldering, for example, the flexible printed circuits 50 the with the respective driver ICs 80 and the respective actuator units 21 so that drive signals outputted by the driver ICs 80 are transmitted to the actuator units 21 of the head body 70.

Heat sinks 82 having a substantially parallel hollow pipe-like areas with a rectangular-like shape (i.e., substantially rectangular parallelepiped in shape) are intimately provided on the outer surface of the driver ICs 80. The heat sinks 28 are provided to efficiently dissipate heat that is generated by the driver ICs 80. Substrates 81 are provided, for example, above the driver ICs 80 and the heat sinks 82, and on the outer surfaces of the flexible printed circuits 50. Seal members 84 are inserted in the clearance between the upper surfaces of the heat sinks 82 and the lower surfaces of the substrates 81, and in the clearance between the lower surfaces of the heat sinks 82 and the flexible printed circuits 50.

Figure 2:
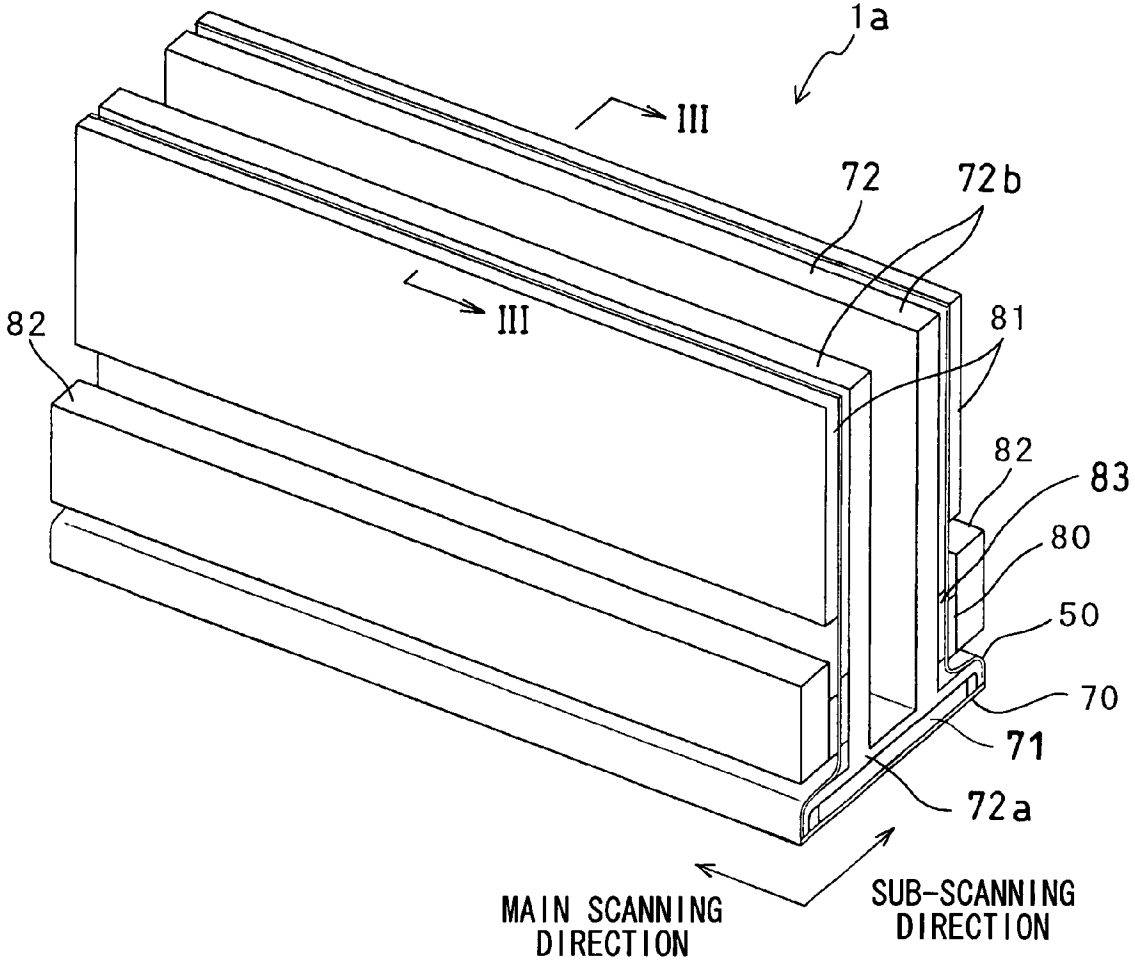
FIG. 2 is a perspective view of an exemplary ink-jet head provided in the ink-jet printer of FIG. 1.

FIG. 4 is a plan view of the exemplary head body 70 of FIG. 2. In FIG. 4, the ink storages 3 provided in the base block 71 are imaginarily indicated by a dashed line. The two ink storages 3 extend along the longitudinal direction of the head body 70, substantially in parallel to and at a predetermined distance from each other. Each of the ink storages 3 of each head body 70 includes an opening 3*a* at one end, and communicates with an ink tank (not shown) via the opening 3*a*. Thus, the ink storages 3 are filled with ink substantially all the time. The ink storages 3 each include a plurality of openings 3*b* provided along the longitudinal direction of the head body 70. As described above, the plurality of openings 3*b* connect each ink storage 3 to the channel unit 4. The plurality of openings 3*b* are paired such that the paired openings 3*b* are disposed close to each other along the longitudinal direction of the head body 70. In the exemplary ink storages 3, the openings 3*b* are provided in pairs and the pairs of openings 3*b* communicating with each of the ink storages 3 are provided in two lines in a staggered arrangement.

In areas where the openings 3*b* are not provided, the plurality of trapezoidal actuator units 21 are provided in two lines and in a reverse staggered arrangement relative to the staggered arrangement of the pairs of openings 3*b*. Each actuator unit 21 is disposed such that opposing parallel sides (upper and lower sides) thereof extend in a direction substantially parallel to the longitudinal direction of the head body 70. Oblique sides of neighboring actuator units 21 partially overlap each other in the width (lateral) direction of the head body 70.

FIG. 5 shows an enlarged view of the area enclosed with a dashed line in FIG. 4. As shown in FIG. 5, the openings 3*b* provided to the ink storages 3 communicate with respective manifolds 5, which are common ink chambers. An end of each manifold 5 branches, for example, into two sub-manifolds 5*a*. When viewed from above, the two sub-manifolds 5*a* extend from each of the adjacent openings 3*b* toward the oblique sides of the actuator units 21. That is, in the exemplary head body 70 illustrated in FIGS. 4 and 5 a total of four sub-manifolds 5*a* extend under each actuator unit 21 so as to extend along the opposing parallel sides of the actuator unit 21, at a predetermined distance from each other.

A lower surface of the channel unit 4 corresponding to the adhered area of each actuator unit 21 includes an ink ejecting area. In the surface of each ink ejecting area, a plurality of nozzles 8 are arranged in a matrix, as described later. Although FIG. 5 does not show all of the plurality of nozzles 8 in order to simplify the drawing, the nozzles 8 are provided in the entire ink ejecting area of each actuator 21.

FIG. 6 shows an enlarged view of the area enclosed by a dashed line in FIG. 5, wherein a plane in which a plurality of pressure chambers 10*n* (e.g., 10*a* to 10*d* are illustrated) are arranged in a matrix in the channel unit 4 is shown, as viewed from a direction perpendicular to the ink ejecting surface. Each pressure chamber 10*n* has a substantially rhombic planar shape and rounded corners when viewed from above. When diagonal lines are provided along each rhombic-shaped pressure chamber 10*n*, each pressure chamber 10*n* is arranged such that its longer diagonal line extends parallel to the width direction of the channel unit 4. In each pressure chamber 10*n*, one end thereof communicates with the nozzle 8 and the other end thereof communicates with the sub-manifold 5*a*, as the common ink channel, via an aperture 12 (FIG. 6). Individual electrodes 35 are provided on the actuator units 21 at positions corresponding to the pressure chambers 10*n* (10*a* to 10*d*), which can be seen when viewed from above. Each individual electrode 35 has a shape similar to the pressure chamber 10*n*, when viewed from above, and is slightly smaller in size than the pressure chamber 10*n*. FIG. 6 does not show all of the individual electrodes 35 in order to simplify the drawing. It should be noted that, in FIGS. 5 and 6, the pressure chambers 10*n* and the apertures 12 are indicated by a solid line for the purpose of clarity although they should be indicated by a dashed line because they are provided inside of the actuator units 21 or the channel unit 4.

As shown in FIG. 6, a plurality of rhombic areas 10*x*, which are imaginary areas indicated by a dashed line, are arranged adjacent to each other in a matrix in two directions (i.e., an arrangement direction F (a first direction) and an arrangement direction G (a second direction)), as indicated by arrows in FIG. 6. The plurality of rhombic areas 10*x* do not overlap each other. The rhombic areas 10*x* house the respective pressure chambers 10*n* therein. The arrangement direction F is coincident with the longitudinal direction of the ink-jet head 1*a*, that is, the extending direction of the sub-manifolds 5*a*, and extends in a direction substantially parallel to a shorter diagonal line of each rhombic area 10*x*. The arrangement direction G is substantially coincident with the direction along one oblique side of the rhombic area 10*x* and forms an obtuse angle θ with the arrangement direction F. Each exemplary pressure chamber 10*n* and each corresponding rhombic area 10*x* have a common center. The contours of the exemplary pressure chambers 10*n* and the corresponding rhombic areas 10*x* are separated from each other when viewed from above.

The exemplary pressure chambers 10*n* are arranged, for example, in a matrix adjacent to each other in the arrangement directions F and G and at a distance R corresponding to 37.5 dpi (dots per inch) from each other in the arrangement direction F. In some embodiments of the exemplary ink-jet head 1*a*, there are a maximum of eighteen pressure chambers 10*n* in the arrangement direction G in each ink ejection area. The pressure chambers 10*n* provided along the both end lines, and extending in the arrangement direction G, of each ink ejection area, are pseudo pressure chambers, which do not contribute to ink ejection.

The plurality of pressure chambers 10*n* arranged in a matrix provide a plurality of rows of the pressure chambers 10 in the arrangement direction F, as shown in FIG. 6. The rows of the pressure chambers 10 include, for example, first pressure chamber rows 11*a*, second pressure chamber rows 11*b*, third pressure chamber rows 11*c*, and fourth pressure chamber rows 11*d*, in accordance with a positional relationship with the sub-manifolds 5*a*, when viewed from a direction perpendicular to the drawing sheet of FIG. 6 (a third direction). The first to fourth pressure chamber rows 11*a* to 11*d* are alternately arranged in order beginning with the third pressure chamber row 11*c*, followed by the fourth pressure chamber row 11*d*, the first pressure chamber row 11*a*, and the second pressure chamber row 11*b*, from the upper side to the lower side in each of the actuator units 21, as illustrated in FIG. 6. Four of each of the first to fourth pressure chamber rows 11*a* to 11*d* may be arranged, for example, in each of the exemplary actuator units 21. In such an exemplary arrangement, the pressure chamber rows 11*a* to 11*d* include sixteen nozzle lines.

The first pressure chamber rows 11*a* include pressure chambers 10*a* and the second pressure chamber rows 11*b* include pressure chambers 10*b*. In the pressure chambers 10*a* and 10*b*, the nozzles 8 are disposed along one side, i.e., the lower side, of the drawing sheet of FIG. 6, with respect to the fourth direction which is perpendicular to the arrangement direction F. The nozzles 8 are located at lower portions of the corresponding rhombic areas 10*x*. The third pressure chamber rows 11*c* include pressure chambers 10*c* and the fourth pressure chamber rows include pressure chambers 10*d*. In the pressure chambers 10*c* and 10*d*, the nozzles 8 are disposed along another side, i.e., the upper side, of the drawing sheet of FIG. 6, with respect to the fourth direction. In the first and fourth pressure chamber rows 11*a* and 11*d*, more than half of the areas of the pressure chambers 10*a*, 10*d* overlap the sub-manifolds 5*a*. In the second and third pressure chamber rows 11*b* and 11*c*, no portion of the pressure chambers 10*b*, 10*c* overlap the sub-manifolds 5*a*. With such an arrangement, ink can be smoothly supplied to each pressure chamber 10*n* while the widths of the sub-manifolds 5*a* are extended as much as possible, and the nozzles 8, which communicate with the pressure chambers 10*n* belonging to any of the pressure chamber rows 11*a* to 11*d*, do not overlap the sub-manifolds 5*a*.

Figure 7:
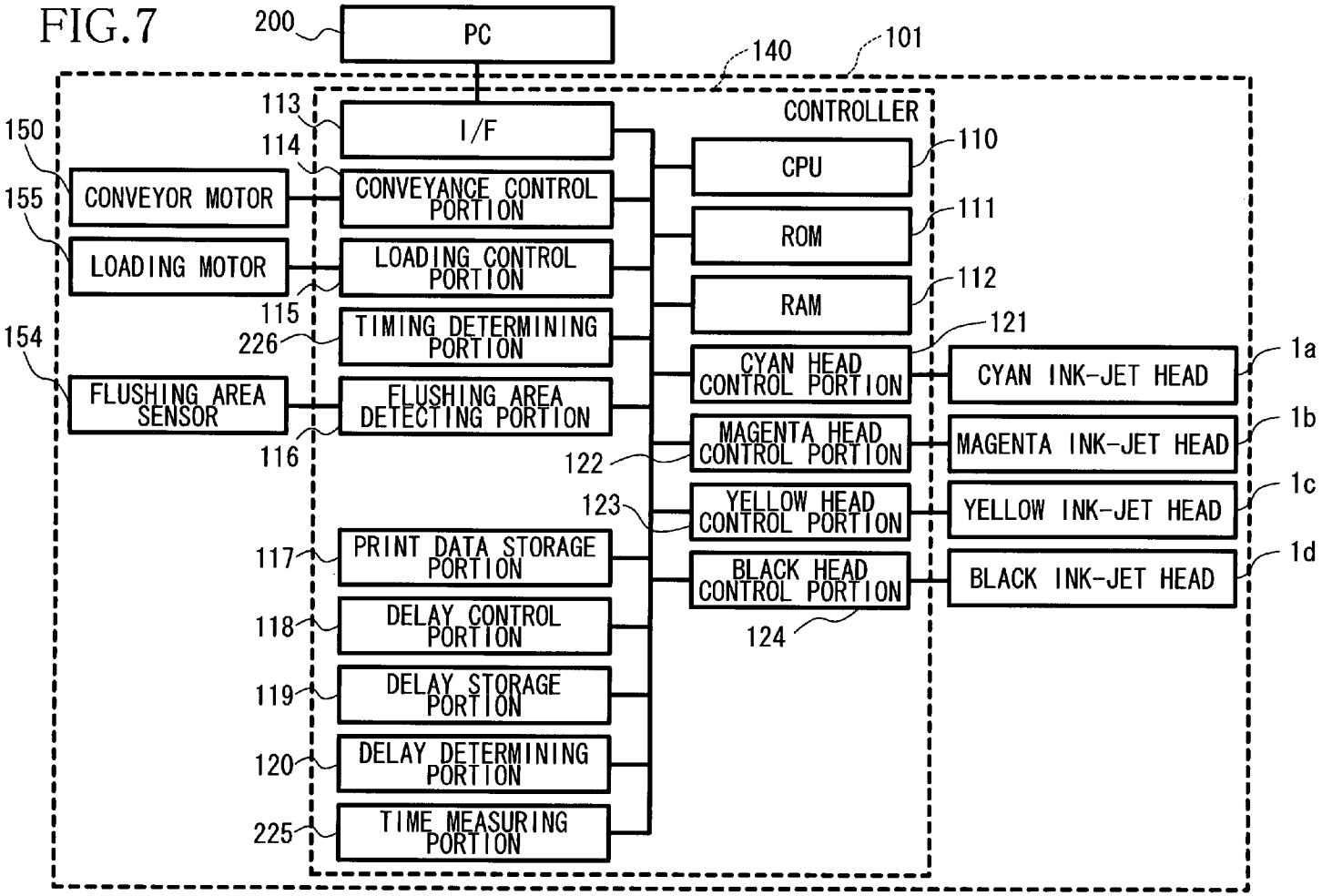
FIG. 7 is a functional block diagram of the an exemplary ink-jet printer employing one or more aspects of the invention.

The controller 140 will be described in detail with reference to FIGS. 7 and 8. FIG. 8 is a plan view of the conveyor belt 108 for explaining the functions of the controller 140. FIG. 8 shows a condition where one of the markings 153 of the conveyor belt 108 is detected by the flushing area sensor 154. As discussed above, the direction indicated by the arrow E also refers to the traveling direction of the conveyor belt 108. As shown in FIG. 7, the controller 140 includes a CPU 110 as an operating device, a ROM 111 that stores programs to be executed by the CPU 110 and data to be used by the programs, and a RAM 112 that temporarily stores data during execution of the programs. The CPU 110, the ROM 111, and the RAM 112 function to control other functional portions described below. More specifically, the CPU 110 issues a command to control the other functional portions. Then, each functional portion writes its status into a predetermined registry of the RAM 112. The CPU 110 refers to the contents of the registry to determine the status of each functional portion.

The controller 140 includes, as the functional portions, an interface (I/F) 113, a conveyance control portion 114, a loading control portion 115, a timing determining portion 226, a flushing area detecting portion 116, a print data storage portion 117, a delay control portion 118, a delay storage portion 119, a delay determining portion 120, a time measuring portion 225, a cyan head control portion 121, a magenta head control portion 122, a yellow head control portion 123, and a black head control portion 124. These functional portions are hardware components achieved by ASICs (Application Specific Integrated Circuits). A single ASIC may include a single functional portion, some of the functional portions, or all of the functional portions. The CPU 110 controls the functional portions by checking the status of each functional portion in accordance with the program stored in the ROM 111 and by issuing a command with respect to each functional portions.

The interface (I/F) 113 is provided to allow the PC 200 operated by the user to connect the ink-jet printer 101. The conveyance control portion 114 controls the conveyor motor 150 that drives the belt rollers 106, 107. The loading control portion 115 controls the loading motor 155 that drives the loading device 109 so as to place the sheet P on the printing area 151. The timing determining portion 226 determines a time at which the loading control portion 115 drives the loading motor 155 so that a sheet P is placed on the conveyor belt 108 such that a downstream end of the sheet P is close to an upstream end of the flushing area 152. The timing determining portion may determine, for example, when a distance between the downstream end of the sheet P and the upstream end of the flushing area 152 is smaller than or equal to the width of the head body 70 in the sub-scanning direction (the direction parallel to the sheet conveying direction E). The timing determining portion helps determine, for example, when the sheet P should be placed on the conveyor 108 at a minimum distance from a downstream end of a portion of the flushing area 152 such that by the time the downstream end of the sheet P reaches each of the nozzle portions of the each of the ink-jet heads, that nozzle portion has recently completed preliminary ink ejection. The flushing area detecting portion 116 detects the position of the flushing area 152, based on the detection result of the marking 153 of the conveyor belt 108 by the flushing area sensor 154. Further, the flushing area detecting portion 116 outputs a trigger signal to the delay control portion 118 when it detects the flushing area 152. The print data storage portion 117 stores print data to be printed, as image data. The print data is transmitted to the ink-jet printer 101 via the interface 113 from the PC 200 by which the user performs an operation for print execution.

The delay control portion 118 delays a flushing start time of each nozzle line of each ink-jet head 1*a* to 1*d* so that the nozzle lines, which include the nozzles 8 communicating with the pressure chamber rows 11*a* to 11*d* of the actuator units 21 that are arranged opposite to the flushing area 152, perform flushing one at a time, after the flushing area 152 is detected by the flushing area detecting portion 116.

The delay storage portion 119 stores a delay time for each of the nozzle lines. Each delay time corresponds to an amount of time that the delay control portion 118 is to delay the flushing start time of the corresponding nozzle line of each ink-jet head 1*a* to 1*d*. More specifically, each delay time includes a head delay time for each ink-jet head 1*a* to 1*d* and a nozzle delay time for each nozzle line of each actuator unit 21 of each ink-jet head 1*a* to 1*d*, which are parameterized. The head delay time refers to a time between when one of the flushing areas 152 is detected by the flushing area detecting portion 116 and when the most upstream nozzle line in each ink-jet head 1*a* to 1*d* is substantially opposite to the downstream end of the flushing area 152 (i.e., when the downstream end of the flushing area is moved to be substantially opposite to the most upstream nozzle line of that ink-jet head). The nozzle delay time refers to a time between when the most upstream nozzle line in each ink-jet head 1*a* to 1*d* is opposite to the downstream end of the flushing area 152 and when each nozzle line of each actuator unit 21 is opposite to the downstream end of the flushing area 152 (i.e., the time it takes for the downstream end of the flushing area to be moved to be substantially opposite to each nozzle line of an ink-jet head from the time when the most downstream end of the flushing area was substantially opposite to the most upstream nozzle line of that ink-jet head.

The delay determining portion 120 determines each head delay time and each nozzle delay time to be stored in the delay storage portion 119. The head delay time is determined in accordance with a physical distance (for example, A to D in FIG. 8) between the most upstream nozzle line of each ink-jet head 1*a* to 1*d* and the downstream end of the flushing area 152 after one of the markings 153 is detected by the flushing area sensor 154, and the rotating speed of the conveyor motor 150. The nozzle delay time is determined in accordance with a physical distance between the most upstream nozzle line of each ink-jet head 1*a* to 1*d* and each nozzle line of each actuator unit 21 of each inkjet head 1*a* to 1*d*, and the rotating speed of the conveyor motor 150. The delay determining portion 120 is called up when the printing speed is changed and obtains the head delay times and the nozzle delay times based on the set printing speed. The head delay times and the nozzle delay times obtained by the delay determining portion 120 are stored in the delay storage portion 119.

The time measuring portion 225 is a counter that measures an elapsed time that has elapsed since the one of the markings 153 is detected by the flushing area sensor 154. The time measured by the time measuring portion 225 is reset every time one of the markings 153 is detected by the flushing area sensor 154.

The cyan head control portion 121 controls the head body 70 of the ink-jet head 1*a*. The magenta head control portion 122 controls the head body 70 of the ink-jet head 1*b*. The yellow head control portion 123 controls the head body 70 of the ink-jet head 1*c*. The black head control portion 124 controls the head body 70 of the ink-jet head 1*d*.

Figure 9:
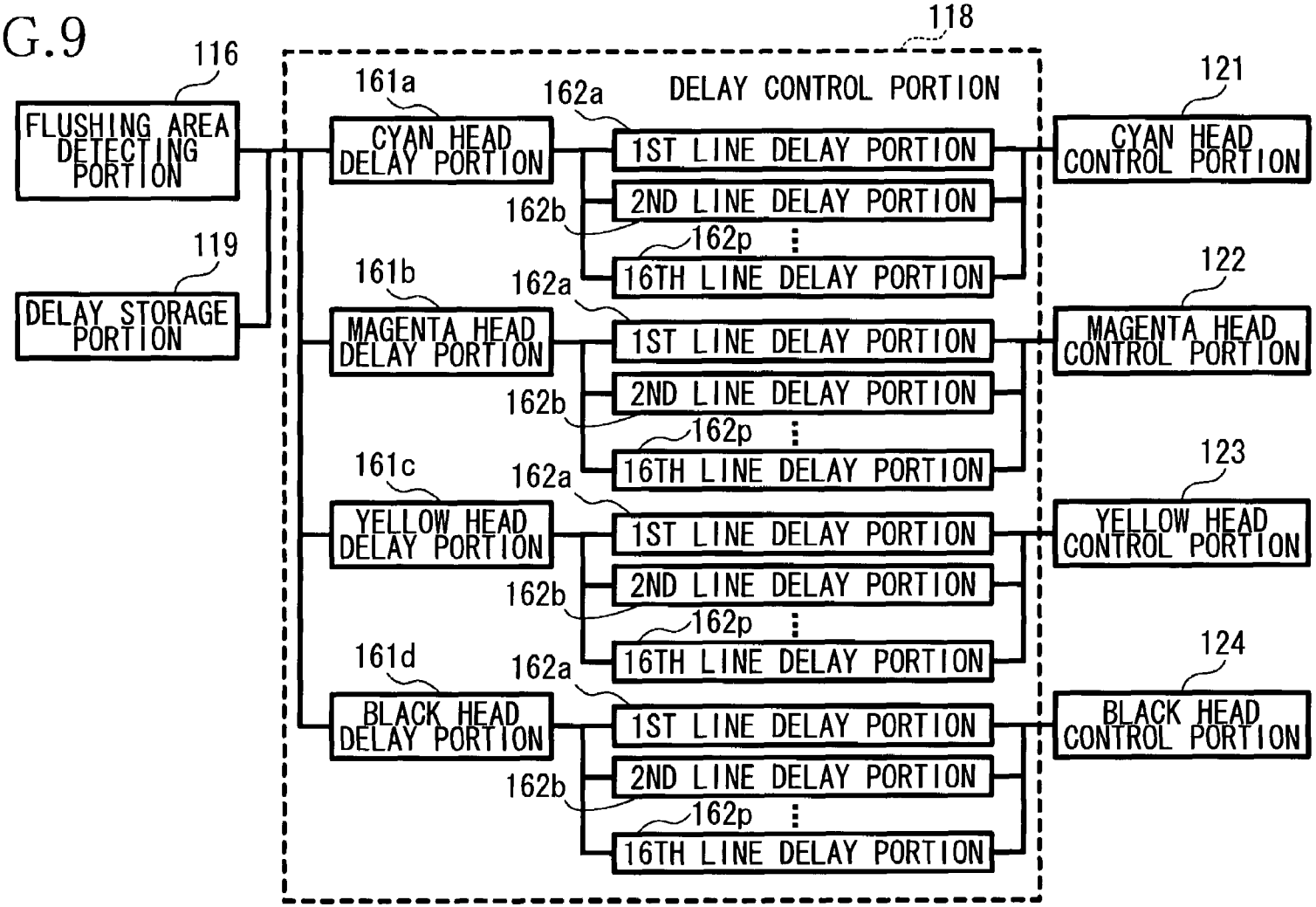
FIG. 9 is a functional block diagram of an exemplary delay control portion employing one or more aspects of the invention.

Next, the delay control portion 118 will be described in detail. As shown in FIG. 9, the delay control portion 118 includes a cyan head delay portion 161*a*, a magenta head delay portion 161*b*, a yellow head delay portion 161*c*, a black head delay portion 161*d*, and first to sixteenth line delay portions 162*a* to 162*p*, for example. The head delay portions 161*a* to 161*d* delay the flushing start times of the ink-jet heads 1*a* to 1*d*, respectively. The first to sixteenth line delay portions 162*a* to 162*p* delay the flushing start times of the respective nozzle lines. Each of the head delay portions 161*a* to 161*d* includes, for example, the first to sixteenth line delay portions 162*a* to 162*p*.

Figure 10:
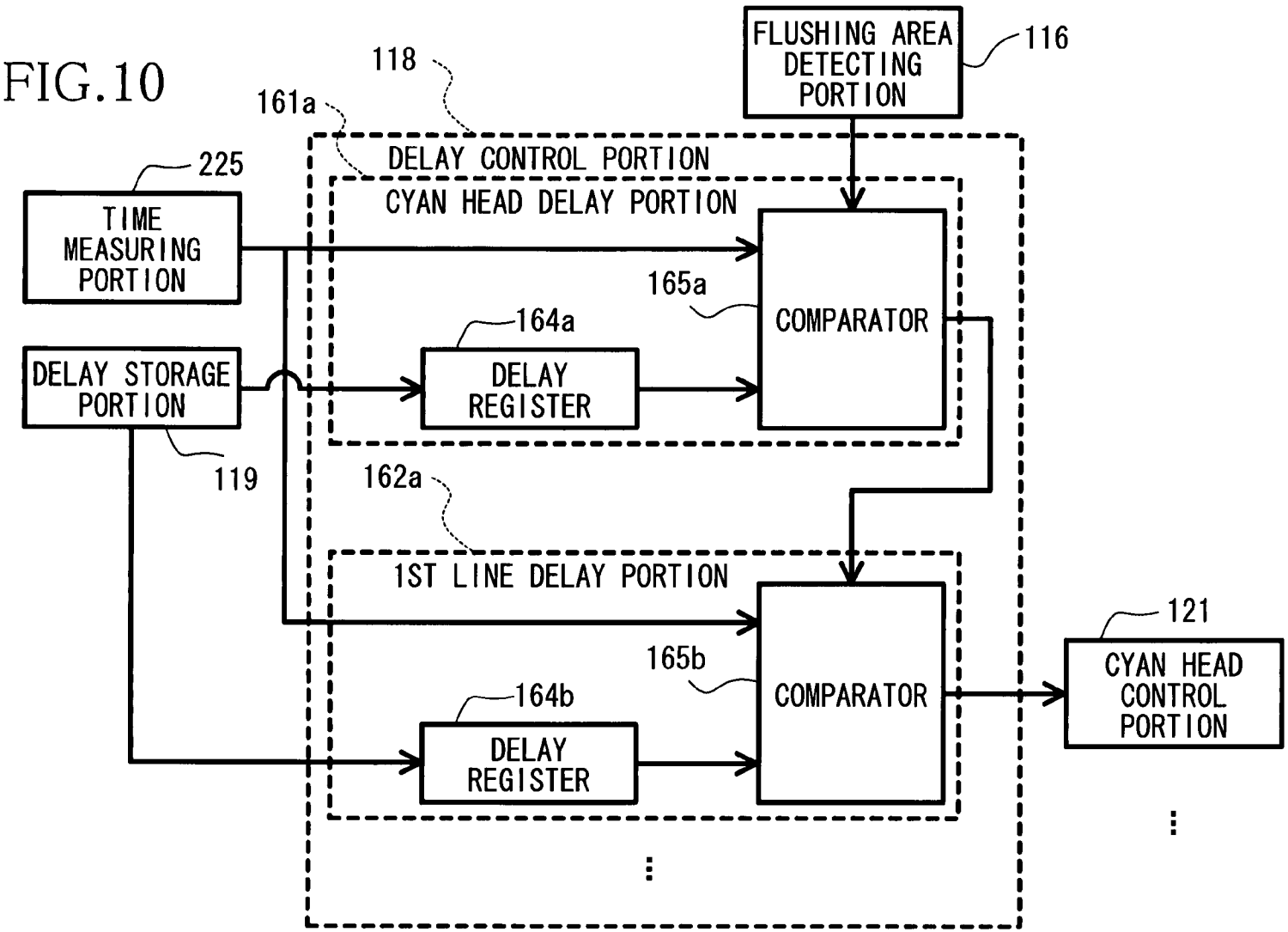
FIG. 10 is a detailed functional block diagram of the delay control portion illustrated in FIG. 9.

The structures of the head delay portions 161*a* to 161*d* and the first to sixteenth line delay portions 162*a* to 162*p* will be described. All the head delay portions 161*a* to 161*d*, in this exemplary embodiment of one or more aspects of the invention, have substantially the same structure. In this exemplary embodiment of one or more aspects of the invention, all of the first to sixteenth line delay portions 162*a* to 162*p* also have substantially the same structure. Therefore, hereinafter, the cyan head delay portion 161*a* and the first line delay portion 162*a* will be described. As shown in FIG. 10, the cyan head delay portion 161*a* includes a delay register 164*a* and a comparator 165*a*. The delay register 164*a* stores the head delay time of the ink-jet head 1*a* stored in the delay storage portion 119. The comparator 165*a* compares the elapsed time measured by the time measuring portion 225 with the head delay time stored in the delay register 164*a* after a trigger signal (a flushing area detection trigger) is inputted into the comparator 165*a* from the flashing area detecting portion 116. The comparator 165*a* outputs a trigger signal (a cyan head delay trigger) to the first line delay portion 162*a* when the values of the elapsed time and the head delay time match with each other.

The first line delay portion 162*a* includes a delay register 164*b* and a comparator 165*a*, like the cyan head delay portion 161*a*. The delay register 164*b* stores the delay time that is a sum of the head delay time of the ink-jet head 1*a* and the nozzle delay time of the first nozzle line from the upstream end of the ink-jet head 1*a*, which are stored in the delay storage portion 119. The comparator 165*b* compares the elapsed time measured by the time measuring portion 225 with the delay time stored in the delay register 164*b* after a trigger signal (a flushing area detection trigger) is inputted into the comparator 165*b* from the flushing area detecting portion 116. The comparator 165*b* outputs a trigger signal (a cyan head first line delay trigger) to the cyan head control portion 121 when the values of the measured time and the delay time match each other. In each of the first to sixteenth line delay portions 162*a* to 162*p*, the delay time, which is a sum of the head delay time of the ink-jet head 1*a* and the nozzle delay time of each nozzle line, is stored in the delay register 164*a* to 164*p*.

Figure 11:
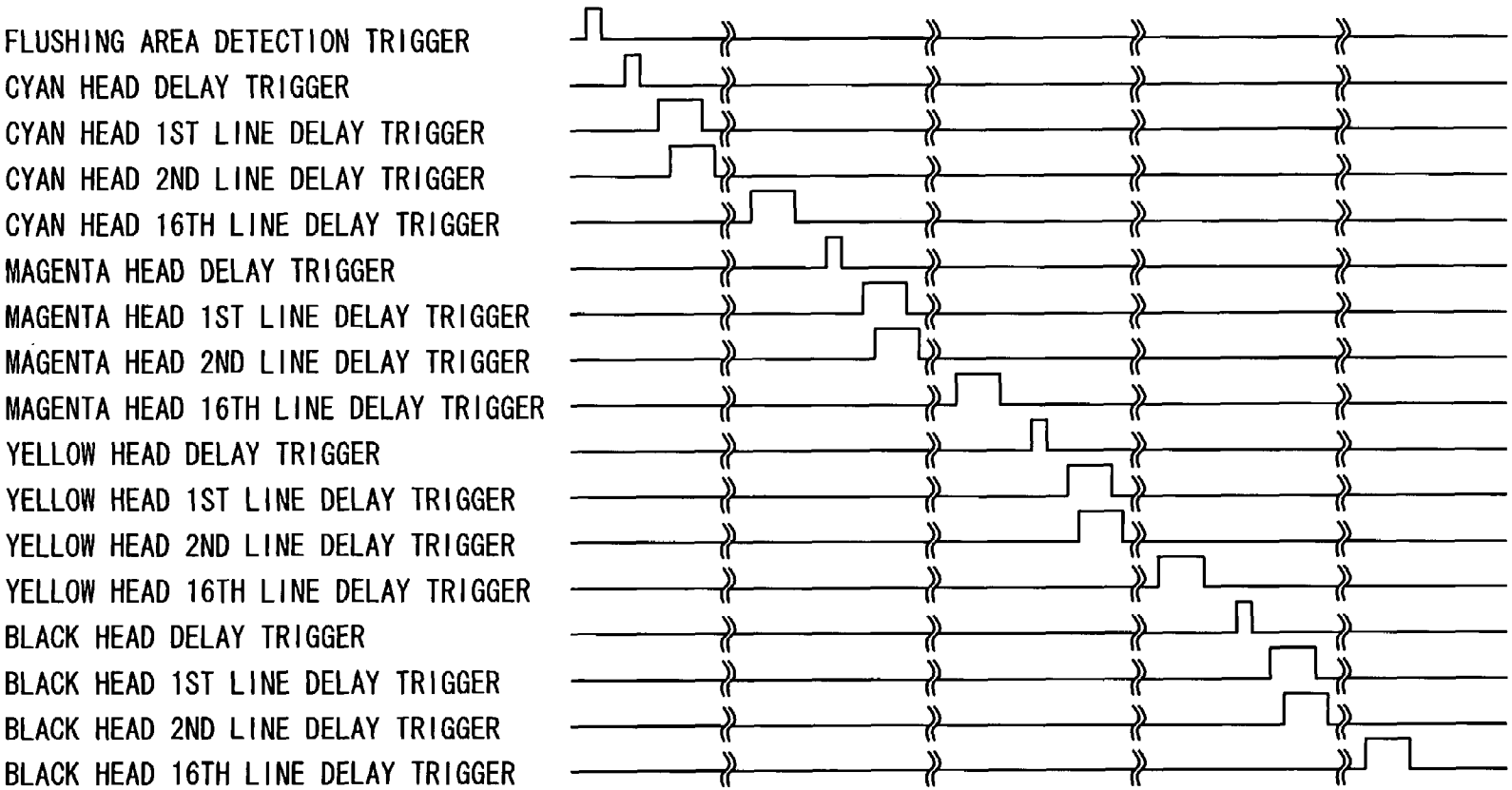
FIG. 11 is a diagram showing waveform patterns representing an operation of the delay control portion illustrated FIG. 9.

As shown in FIG. 11, after the flushing area detecting portion 116 outputs a trigger signal (a flushing area detection trigger), the cyan head delay portion 161*a* outputs a trigger signal (a cyan head delay trigger) in accordance with the trigger signal outputted by the flushing area detecting portion 116. After that, the first to sixteenth line delay portions 162*a* to 162*p* output respective trigger signals (a cyan head first line delay trigger to a cyan head sixteenth line delay trigger) in order. Then, the nozzle lines in the ink-jet head 1*a* perform, by turns, the flushing. The trigger signal outputted from each of the first to sixteenth line delay portions 162*a* to 162*p* has a predetermined time width. The flushing is performed while the trigger signal is high. In this exemplary embodiment, the nozzles 8 of each line eject ink about 20 times during the flushing. Further, in accordance with the trigger signal (the flushing area detection trigger) outputted from the flushing area detecting portion 116, the magenta head delay portion 161*b* outputs a trigger signal (a magenta head delay trigger) and then the line delay portions 162*a* to 162*p* of the magenta head delay portion 161*b* output respective trigger signals (a magenta head first delay trigger to a magenta head sixteenth delay trigger). Then, the nozzle lines corresponding to the pressure chamber rows 11*a* to 11*d* of the ink-jet head 1*b* perform, by turns, the flushing. The same processing is performed on the ink-jet heads 1*c*, 1*d*. The time widths of the delay trigger signals are determined based on the elapsed time measured by the time measuring portion 225.

Figure 12:
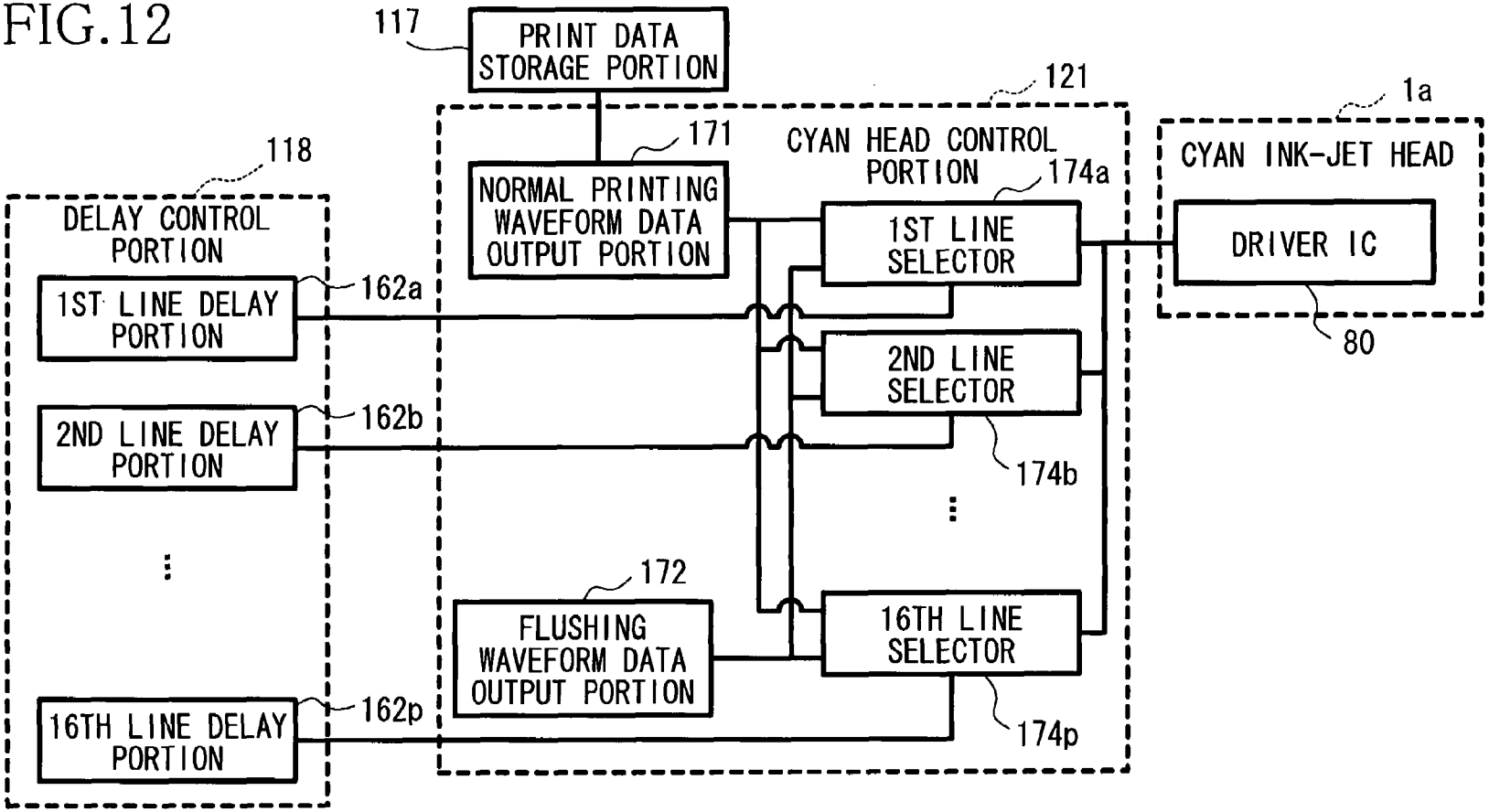
FIG. 12 is a functional block diagram of an exemplary cyan head control portion in which one or more aspects of the invention has been implemented.

Next, the head control portions 121 to 124 will be described in detail. All the head control portions 121 to 124 in this exemplary embodiment of one or more aspects of the invention have substantially the same structure, so that an explanation will be given to the cyan head control portion 121 only. As shown in FIG. 12, the cyan head control portion 121 includes a normal printing waveform data output portion 171, a flushing waveform data output portion 172, and first to sixteenth line selectors 174*a* to 174*p* corresponding to the first to sixteenth nozzle lines, for example. The normal printing waveform data output portion 171 obtains print data to be printed by the ink-jet head 1*a* from print data stored in the print data storage portion 117 and generates waveform data based on gradation level data included in the obtained print data. Then, the normal printing waveform data output portion 171 classifies the generated waveform data into waveform data groups corresponding to the nozzle lines, and outputs the classified waveform data groups to the respective line selectors 174*a* to 174*p*. The gradation level data included in the print data includes, for example, data of four different gradation levels represented by two bits (00 to11). The waveform data includes, for example, data of eight different patterns represented by three bits (000 to 111). For the normal printing, the waveform data represented by 000 to 110 is used, for example. The flushing waveform data output portion 172 outputs waveform data for flushing to each of the first to sixteenth line selectors 174*a* to 174*p*. For the flushing, the waveform data represented by 111 is used, for example. Each of the first to sixteenth line selectors 174*a* to 174*p* outputs the waveform data inputted by one of the normal printing waveform data output portion 171 and the flushing waveform data output portion 172 to the driver IC 80, based on the signal inputted by each of the first to sixteenth line delay portions 162*a* to 162*p*.

Figure 13:
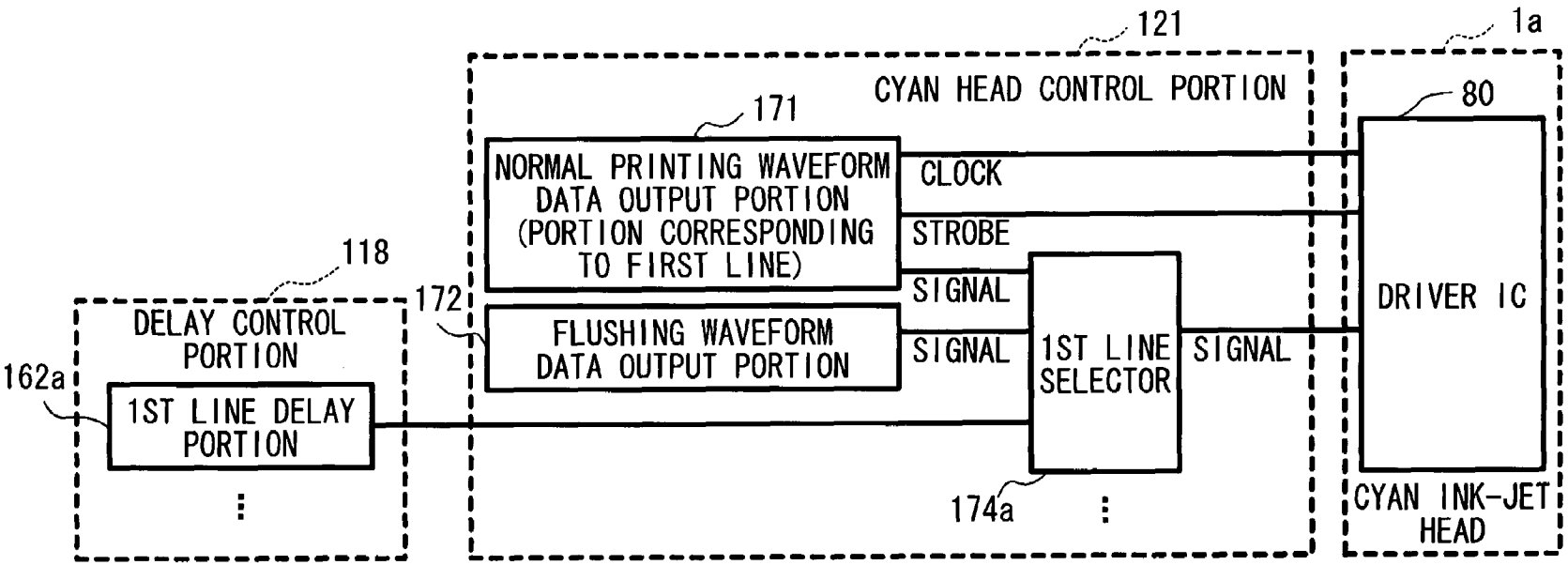
FIG. 13 is a block diagram showing a circuit configuration of the cyan head control portion illustrated in FIG. 12.
Figure 14:
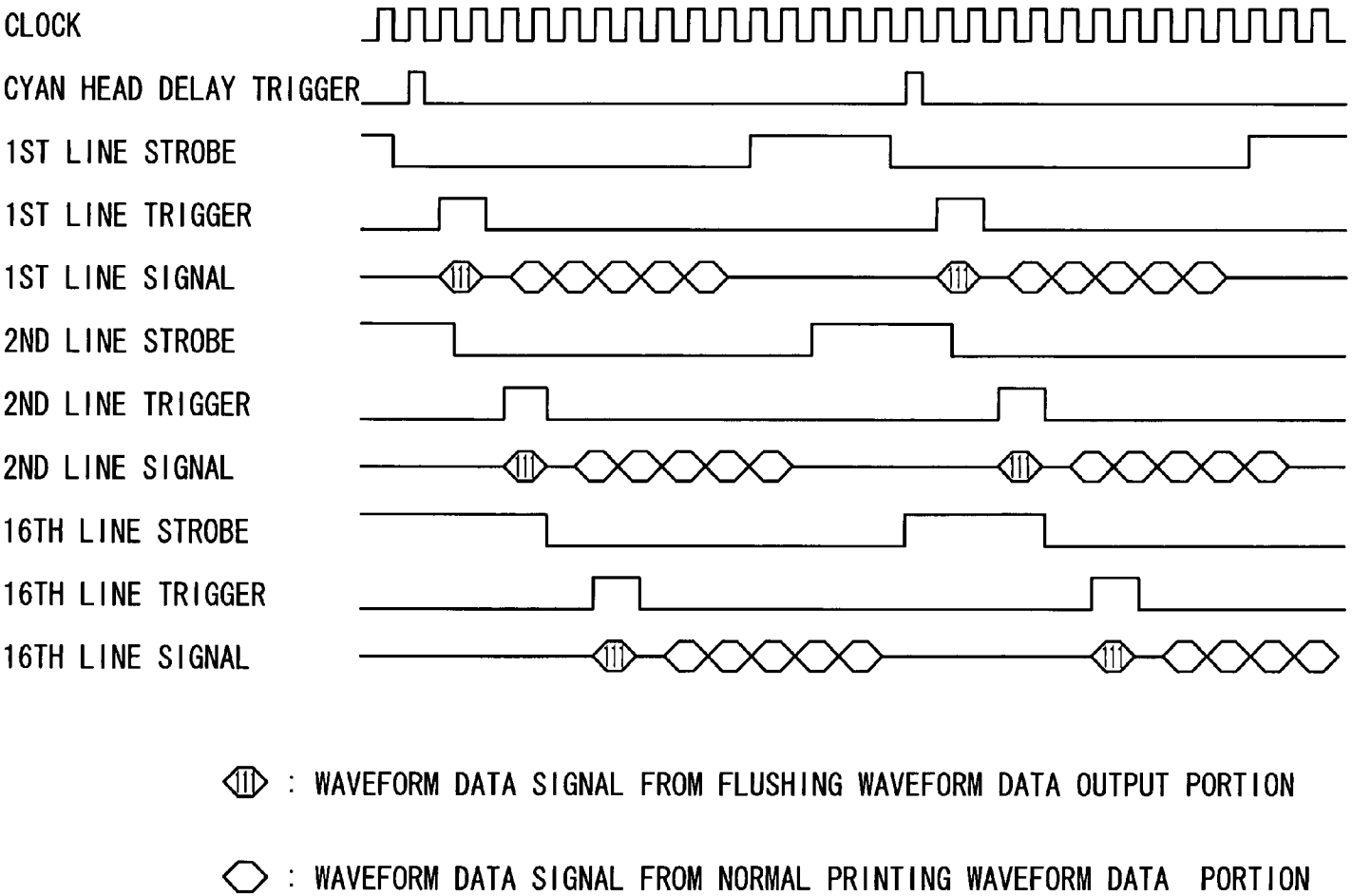
FIG. 14 is a diagram showing operation waveforms in the circuit configuration of the cyan head control portion illustrated in FIG. 12.

Next, a circuit configuration of the cyan head control portion 121 will be described with reference to FIG. 13. In FIG. 13, in the normal printing waveform data output portion 171, only a portion corresponding to the first nozzle line is indicated. FIG. 14 shows operation waveforms to be outputted from the cyan head control portion 121. In FIG. 14, "111" represents a waveform data signal for flushing. As shown in FIG. 13, a clock signal (clock), which is a reference waveform data, and an operation permission signal (strobe), are directly inputted into the driver IC 80 by the normal printing waveform data output portion 171. In addition, waveform data signals (signal) from the normal printing waveform data output portion 171 and the flushing waveform data output portion 172 and a trigger signal from the first line delay portion 162*a* are inputted into the first line selector 174. A waveform data signal (signal) is inputted into the driver IC 80 from the first line selector 174*a*. As shown in FIG. 14, the first line selector 174 inputs the waveform data signal from the normal printing waveform data output portion 171 to the driver IC 80 when the trigger signal from the first line delay portion 162*a* is low, and inputs the waveform data signal from the flushing waveform data output portion 173 to the driver IC 80 when the trigger signal from the first line delay portion 162*a* is high. The driver IC 80 drives the actuator unit 21 based on the inputted waveform data signal only when the operation permission signal (strobe) is low. The substantially same processing is performed on the other lines. As shown in FIG. 14, the first nozzle line performs the normal printing while the second nozzle line performs the flushing.

An operation procedure of the controller 140 during the printing will be described below. When printing is performed on the ink-jet printer 101 in accordance with an issued print execution command by the PC 200, the process illustrated by the flowchart of FIG. 15 starts. At S1101 (S stands for a step), an ejection frequency of the head bodies 70 and a conveying speed of a sheet P are set in accordance with the settings for high-speed printing and high-quality printing, as set by the user. Then, at S102, a delay time is set. More specifically, each head delay time is determined by the delay determining portion 120 and is stored in the delay storage portion 119. The head delay times stored in the delay storage portion 119 are then stored in the respective delay registers 164 of the head delay portions 161*a* to 161*d*. At S103, each nozzle delay time is determined by the delay determining portion 120 and the determined nozzle delay times are stored in the delay storage portion 119. The total of the head delay time for an ink-jet head and the nozzle delay times for each nozzle line of that ink-jet head is then stored in the respective delay registers 164*a*-164*p* of the first to sixteenth delay portions 162*a* to 162*p*. Then, at S104, the settings for performing flushing, such as determination of a flushing time period and a waveform pattern for flushing, are set. At S105, flushing is enabled.

Figure 15:
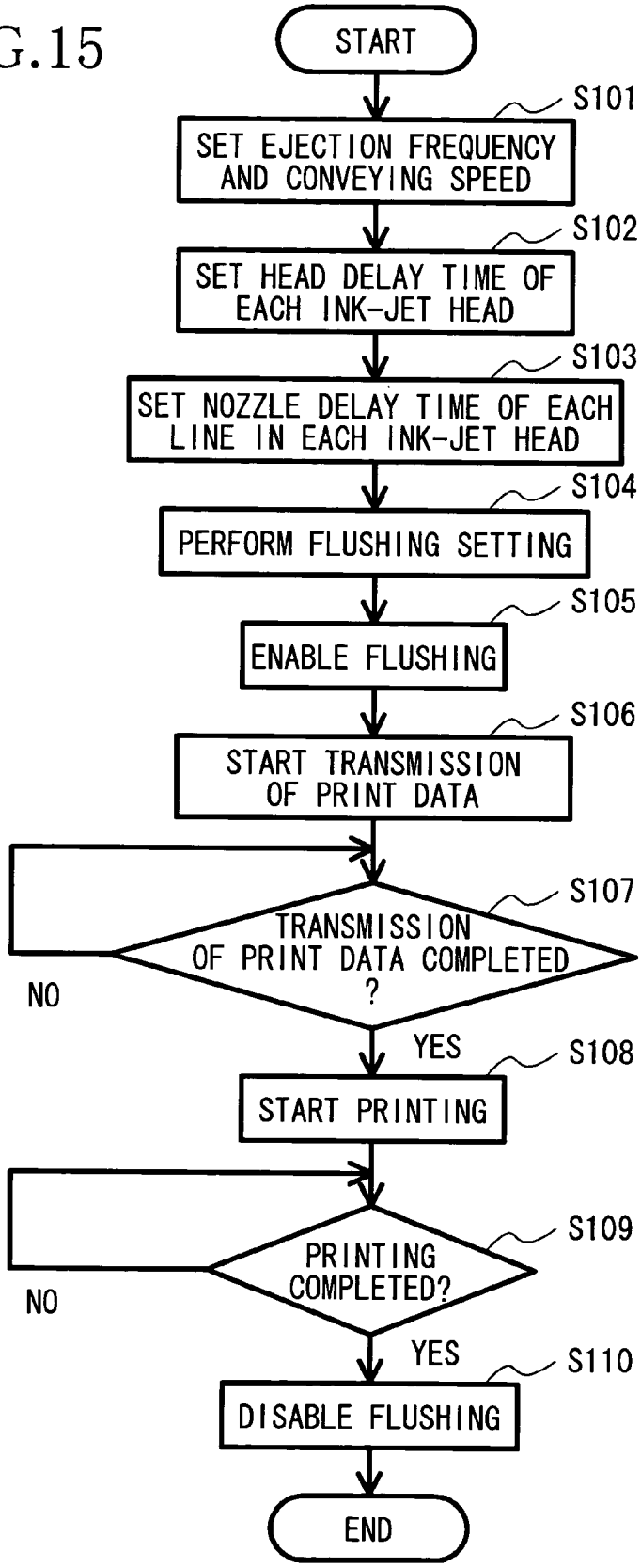
FIG. 15 is a flowchart of an exemplary operating procedure of a controller of an exemplary ink-jet printer employing one or more aspects of the invention.

Then, at S106, a command to start transmission of print data is issued. When the command is issued, the transmission of print data from the PC 200 to the print data storage portion 117 via the interface 113 is started. At S107, a determination is made as to whether the transmission of the print data has been completed. When the transmission of the print data has not been completed yet (S107:NO), the determination of S107 is repeatedly performed until the transmission of the print data is completed. When the transmission of the print data has been completed (S107:YES), flow moves to S108 to issue a command to perform printing. Upon the issue of the print start command, the flushing and the printing are performed while each head body 70 is driven in accordance with the ejection frequency set at S107 and the sheet P is conveyed in accordance with the conveying speed set at S101. Then, at S109, a determination is made as to whether the printing has been completed. If the printing has not been completed yet (S109:NO), the determination of S109 is repeatedly performed until the printing is completed. When the printing has been completed (S109:YES), flow moves to S110 to disable the flushing. Thus, the process of FIG. 15 is finished.

In the exemplary embodiment of one or more aspects of the invention described above, a single nozzle line of an ink-jet head performs flushing independently of another nozzle line of the ink-jet head. In some embodiments, however, as discussed above, a plurality of nozzle lines may perform flushing at the same time. Further, in the exemplary embodiment of one or more aspects of the invention described above, flushing is performed by a most upstream nozzle line or plurality of nozzle lines followed by the next-most upstream nozzle line or plurality of nozzle lines, etc. and the most downstream nozzle line or plurality of nozzle lines perform flushing last. However, in some embodiments, for example, a plurality of flushing areas may be provided such that flushing may be performed by a nozzle portion of two or more ink-jet heads simultaneously. Further, according to one or more aspects of the invention described above, ink ejection for printing and ink ejection for flushing can be performed at the same time by different nozzle lines of a single ink-jet head 1*a* to 1*d*. Therefore, the width of the flushing areas 152 can be shortened in the sheet conveying direction E and the distance between the ends of the flushing area and the ends of the position where the sheet P is placed can be also shortened. Thus, the circumference of the conveyor belt 108 can be shortened, thereby improving throughput of the printing operation. With the shortening of the conveyor belt 108, the size of the conveying device 180 (e.g., circumference of the conveyor belt 108, distance between rollers 106, 107, etc.) and the ink-jet printer can be reduced.

Further, in various exemplary embodiments implementing one or more aspects of the invention, with the provision of the timing determining portion 226, the distance between the end of the sheet P and the end of the flushing area 152 can be shortened. Therefore, the circumference of the conveyor belt 108 can be further shortened.

According to one or more aspects of the invention, flushing can be independently controlled for each nozzle portion (e.g., one nozzle line or a plurality of nozzle lines of an ink-jet head), so that the ink-jet head can be designed such that the flushing is not performed by all the nozzles of the ink-jet head at the same time. With this structure, an electrical load to be instantaneously applied to the driver ICs 80 can be reduced as compared with a conventional flushing in which flushing is performed by all the nozzles of an ink-jet head at substantially the same time.

In various exemplary embodiments implementing one or more aspects of the invention, the head control portions 121 to 124 allow the respective ink-jet heads to independently perform flushing of each nozzle portion (e.g., one nozzle line or a plurality of nozzle lines of an ink-jet head), so that the width of the flushing areas 152 can be further shortened in the sheet conveying direction E. Therefore, the circumference of the conveyor belt 108 can be shortened.

In various exemplary embodiments implementing one or more aspects of the invention, the output of waveform data can be changed either to the waveform data based on the print data or the flushing waveform data by the line selectors 174*a* to 174*p*. Therefore, the processing can be simplified and the speed of the printing operation can be increased.

In various exemplary embodiments implementing one or more aspects of the invention, by setting the delay time in advance the process execution time can be shortened (i.e., made faster). Further, the delay time includes the head delay times and the nozzle delay times, both of which are parameterized. Accordingly, the ink-jet printer can respond to changes in the arrangement and/or the shape of the ink-jet heads.

In various exemplary embodiments implementing one or more aspects of the invention, the delay time can be determined according to the conditions by the delay determining portion 120. The ink-jet printer can thus respond to a change in the printing (conveying) speed, and/or the arrangement and/or the shape of the ink-jet heads.

In various exemplary embodiments implementing one or more aspects of the invention, the delay time can be individually set with respect to each ink-jet head 1*a* to 1*d*. Accordingly, the ink-jet printer can respond to changes in the arrangement and/or the shape of the ink-jet head.

In various exemplary embodiments implementing one or more aspects of the invention, the positions of the flushing areas 152 can be detected via the markings 153, so that the flushing areas 152 can be easily detected at low cost.

In various exemplary embodiments implementing one or more aspects of the invention, based on the elapsed time measured by the time measuring portion 225, the flushing start time and the flushing end time are determined. Accordingly, the flushing can be accurately performed.

In various exemplary embodiments implementing one or more aspects of the invention, a flushing time period signal is generated based on an amount of ink to be ejected and outputted during the flushing, that is, the flushing end time is determined based on the amount of ink to be ejected. Flushing is thus performed in such an embodiment only when the flushing time period signal is effective. By doing so, the ink-jet head can be controlled such that the flushing is not performed when unnecessary even when each nozzle 8 is located at the position opposite to the flushing area.

Next, an ink-jet printer 101A of a second exemplary embodiment of one or more aspects of the invention will be described.

Figure 16:
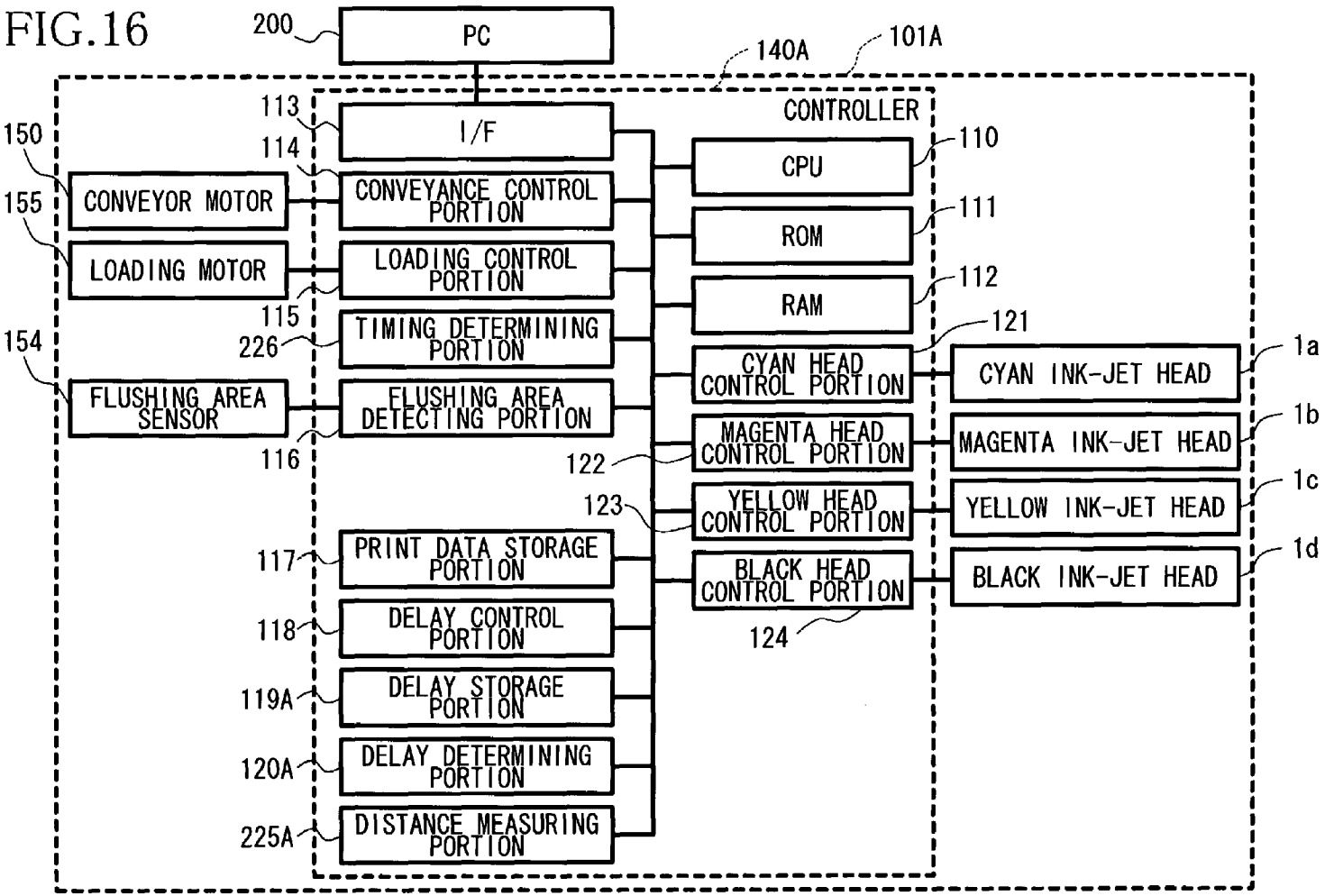
FIG. 16 is a functional block diagram of an exemplary ink-jet printer employing another combination of one or more aspects the invention.

The ink-jet printer 101A of the second exemplary embodiment has substantially the same structure as the ink-jet printer 101 of the first exemplary embodiment except for the controller 140A. Therefore, the same parts are designated with the same reference numerals and explanations for those parts will be omitted. As shown in FIG. 16, in the controller 140A, a delay control portion 119A, a delay determining portion 120A, and a distance measuring portion 225A are different from those portions 119, 120, 225 of the ink-jet printer 101 of the first exemplary embodiment. Explanations will be given to those different portions 119A, 120A, 225A below.

The delay storage portion 119A stores for each nozzle line of each ink-jet head 1*a* to 1*d*, a conveying distance of the conveyor belt 108, which is a distance that the conveyor belt 108 must travel before flushing of that nozzle line will be performed and that distance in relation to each nozzle line is stored in the delay storage portion 119A such that flushing of a nozzle line is delayed until the conveyor belt 108 has traveled the distance amount associated with that nozzle line. More specifically, the delay storage portion 119A stores a head delay distance for each ink-jet head 1*a* to 1*d* and a nozzle delay distance for each nozzle line of each actuator unit 21 of each ink-jet head 1*a* to 1*d*. The head delay distance refers to a distance traveled by the flushing area 152 in a time between when one of the flushing area 152 is detected by the flushing area detecting portion 116 and when the most upstream nozzle line in each ink-jet head 1*a* to 1*d* is substantially opposite to the downstream end of the flushing area 152. The nozzle delay distance refers to a distance traveled by the flushing area 152 in a time between when the most upstream nozzle line in each ink-jet head 1*a* to 1*d* is substantially opposite to the downstream end of the flushing area 152 and when each of the nozzle lines of each actuator unit 21 is substantially opposite to the downstream end of the flushing area 152. In this exemplary embodiment, the number of rotation steps of the conveyor motor 150 is referred to as the conveying distance.

The delay determining portion 120A determines each head delay distance and each nozzle delay distance to be stored in the delay storage portion 119A. The head delay distance is determined in accordance with a physical distance (for example, a distance A to D in FIG. 8) between the most upstream nozzle line of each ink-jet head 1*a* to 1*d* and the downstream end of the flushing area 152 after one of the markings 153 is detected by the flushing area sensor 154. The nozzle delay distance is determined in accordance with a physical distance between the most upstream nozzle line of each ink-jet head 1*a* to 1*d* and each nozzle line of each actuator unit 21 of each ink-jet head 1*a* to 1*d*. The head delay distances and the nozzle delay distances obtained by the delay determining portion 120A are stored in the delay storage portion 119A.

The distance measuring portion 225A is a counter that measures a distance that the conveyor belt 108 has traveled (the number of rotation steps of the conveyor motor 150) from the time when one of the markings 153 is detected by the flushing area sensor 154. The distance measured by the distance measuring portion 225A is reset every time one of the markings 153 is detected by the flushing area sensor 154.

The delay control portion 118 and the head control portions 121 to 124 have substantially the same structure as those portions 118, 121 to 124 of the first exemplary embodiment. In the first exemplary embodiment, each portion 118, 121 to 124 functions based on the head delay times and the nozzle delay times. In the second exemplary embodiment, each portion 118, 121 to 124 functions based on the head delay distances and the nozzle delay distances.

In various exemplary embodiments implementing one or more aspects of the invention, by setting the delay distance in advance to simplify the other process, speedup of the process execution can be achieved. Further, because, for example, in some embodiments each delay distance includes the head delay distances and the nozzle delay distances, both of which are parameterized. Accordingly, the flushing mechanism can respond flexibly to changes in the arrangement and/or the shape of the ink-jet heads.

In addition, in various exemplary embodiments implementing one or more aspects of the invention, the delay distance can be determined according to the conditions by the delay determining portion 120A and thus, the flushing mechanism can respond flexibly to a change in the printing (conveying) speed, the arrangement and/or the shape of the ink-jet heads.

The delay distance can be individually set with respect to each ink-jet head 1*a* to 1*d* and thus, the flushing mechanism can respond flexibly to a change in the arrangement and/or the shape of the ink-jet head.

In various exemplary embodiments implementing one or more aspects of the invention, based on the traveled distance measured by the distance measuring portion 225A, the flushing start time and the flushing end time are determined and thus, the flushing can be precisely performed.

While the invention has been described in detail with reference to the specific embodiments thereof, it would be apparent to those skilled in the art that various changes, arrangements and modifications may be applied therein without departing from the spirit and scope of the invention. For example, in the first exemplary embodiment, each nozzle line includes the adjacent nozzles 8 communicating with the corresponding pressure chamber rows 11*a* to 11*d*. However, each nozzle line may include nozzles 8 which have different ink ejection characteristics and are not adjacent to each other.

In the above exemplary embodiments of one or more aspects of the invention, the ink-jet printer 101, 101A includes the loading portion 109, wherein the loading portion 109 places a sheet P onto the printing area 151, based on the timing determined by the timing determining portion 226. It may be designed such that the loading device 109 places a sheet P onto the printing area 151 based on other conditions, such as a predetermined timing determined by the loading device 109, without providing the timing determining portion 226.

In the above exemplary embodiments, a single nozzle line in each ink-jet head 1*a* to 1*d* performs the flushing by one at a time. In other exemplary embodiments, a plurality of nozzle lines in each ink-jet head 1*a* to 1*d* may perform flushing at the same time.

In the above exemplary embodiments, each of the first to sixteenth line selectors 174*a* to 174*p* outputs one of waveform data inputted from the normal printing waveform data output portion 171 and waveform data inputted from the flushing waveform data output portion 172 to the driver ICs 80. However, in some embodiments, the first to sixteenth line selectors 174*a* to 174*p* may not be necessary and thus, may not be provided. In such cases, the waveform data for flushing is included in print data in advance and the waveform data inputted from the normal printing waveform data output portion 171 is outputted to the driver ICs 80.

In the first exemplary embodiment, the head control portions 121 to 124 performs the flushing based on the time measured by the time measuring portion 225 and the delay times stored in the delay storage portion 119. In such embodiments, the flushing may be performed based on a predetermined timing without providing the time measuring portion 225 and the delay storage portion 119.

In the first exemplary embodiment, the delay time includes the head delay times and the nozzle delay times, both of which are parameterized. In other embodiments, the delay time may be directly parameterized without being separated into head delay times and nozzle delay times. In other embodiments, it may not be necessary for the head delay times and nozzle delay times to be parameterized.

In the first exemplary embodiment, the head delay times and the nozzle delay time are obtained by the delay determining portion 120. In other embodiments, both delay times may be limited to predetermined values.

In the above exemplary embodiments, the head control portions 121 to 124 use the respective delay times. In other embodiments, the head control portions 121 to 124 may use common delay times.

In the second exemplary embodiment, each head control portion 121 to 124 controls the ink-jet head(s) to perform the flushing based on the distance measured by the distance measuring portion 225A and each delay distance stored in the delay storage portions 119A. In other embodiments, each head control portion 121 to 124 may control the ink-jet heads such that flushing is performed based on a predetermined timing, without providing the distance measuring portion 225A and the delay storage portion 119A.

In the second exemplary embodiment, the delay distance includes the head delay distances and the nozzle delay distances, both of which are parameterized. In other embodiments, the delay distance may be directly parameterized without being separated into head delay distances and nozzle delay distances. In other embodiments, it may not be necessary for the head delay distances and nozzle delay distances to be parameterized.

In the second exemplary embodiment, the head delay distances and the nozzle delay distances are determined by the delay determining portion 120A. In some embodiments, both the delay distances may be limited to predetermined contents.

In the second exemplary embodiment, the head control portions 121 to 124 use the respective delay distances. In some embodiments, the head control portions 121 to 124 may use common delay distances.

Any or all of the systems and subsystems discussed herein can be implemented on a special purpose computer, a programmed microprocessor or microcontroller and peripheral integrated circuit elements, an ASIC or other integrated circuit, a digital signal processor, a hardwired electronic or a logic circuit such as a discrete element circuit, a programmable logic device such as a PLD, a PLA, a FPGA or a PAL, or the like. Thus, it should be understood that each of the various systems and subsystems shown in FIGS. 7, 9, 10, 12, 13 and 16 can be implemented as portions of a suitably programmed general purpose computer. Alternatively, each of the systems or subsystems shown in FIGS. 7, 9, 10, 12, 13 and 16 can be implemented as physically distinct hardware circuits within an ASIC, or using a FPGA, a PLD, a PLA, or a PAL, or using discrete logic elements or discrete circuit elements. The particular form each of the systems and/or subsystems shown in FIGS. 7, 9, 10, 12, 13 and 16 will take is a design choice and will be obvious and predictable to those skilled in the art.

In various embodiments of one or more aspects of the invention, alterable portions of the memory may be implemented using static or dynamic RAM. However, the memory can also be implemented using a floppy disk and disk drive, a writable optical disk and disk drive, a hard drive, flash memory or the like. In various embodiments of one or more aspects of the invention, the generally static portions of the memory may be implemented using ROM. However, the static portions can also be implemented using other non-volatile memory, such as PROM, EPROM, EEPROM, an optical ROM disk, such as a CD-ROM or DVD ROM, and disk drive, flash memory or other alterable memory, as indicated above, or the like.

Thus, while this invention has been described in conjunction with the exemplary embodiments outlined above, it is evident that many alternatives, modifications and variations will be apparent to those skilled in the art. Accordingly, the exemplary embodiments of these systems and methods according to this invention, as set forth above, are intended to be illustrative, not limiting. Various changes may be made without departing from the spirit and scope of this invention.

What is claimed is:

1. An ink-jet image forming apparatus, comprising:

an ink-jet head having at least a first nozzle portion and a second nozzle portion, the first nozzle portion and the second nozzle portion ejecting a same color ink, the ink-jet head performing printing ink ejection and preliminary ink ejection, wherein during printing ink ejection the ink-jet head ejects ink to form an image on a surface of a recording medium and during preliminary ink ejection the ink-jet head ejects ink onto a surface of a preliminary ink ejecting section;

a moving member, the moving member capable of supporting the recording medium thereon and including the preliminary ink ejection section, and the moving member moving the recording medium and the preliminary ink ejection section relative to the ink-jet head; and an ink ejection controller, the ink ejection controller controlling the ink-jet head such that when the ink ejection controller determines that the preliminary ink ejection section of the moving member substantially overlaps the first nozzle portion, the first nozzle portion, and not the second nozzle portion, of the ink-jet head performs preliminary ink ejection and when the ink ejection controller determines that the preliminary ink ejection section is subsequently substantially overlapping the second nozzle portion, the second nozzle portion, and not the first nozzle portion, performs preliminary ink ejection.

2. The ink-jet image forming apparatus of claim 1, wherein the ink ejection controller comprises a detector that detects a position determination section which corresponds to a position of the preliminary ink ejection section, the ink ejection controller determining when the preliminary ink ejection section is at a predetermined position based on the detection of the position determination section.

3. The ink-jet image forming apparatus of claim 2, wherein the ink ejection controller further comprises a time determining portion, the time determining portion determining an amount of elapsed time that has elapsed from a time when the preliminary ink ejection section was determined to be at the predetermined position.

4. The ink-jet image forming apparatus of claim 3, wherein the ink ejection controller controls the first nozzle portion of the ink-jet head to perform preliminary ink ejection after the ink ejection controller determines that a first predetermined amount of time has elapsed.

5. The ink-jet image forming apparatus of claim 4, wherein the ink ejection controller controls the second nozzle portion of the ink-jet head to perform preliminary ink ejection after the ink ejection controller determines that a second predetermined amount of time has elapsed.

6. The ink-jet image forming apparatus of claim 5, wherein the ink ejection controller further comprises a storage register that stores a delay time associated with each of the first nozzle portion and the second nozzle portion.

7. The ink-jet image forming apparatus of claim 6, wherein the ink ejection controller further includes a comparator that compares the delay time associated with the first nozzle portion with the amount of time that has elapsed, as determined by the time determining portion, in order to determine when to control the first nozzle portion of the ink-jet head to perform preliminary ink ejection.

8. The ink-jet image forming apparatus of claim 7, wherein after the comparator determines that the delay time associated with the first nozzle portion has elapsed, the comparator compares the delay time associated with the second nozzle portion with the amount of time that has elapsed, as determined by the time determining portion, in order to determine when to control the second nozzle portion of the ink-jet head to perform preliminary ink ejection.

9. The ink-jet image forming apparatus of claim 8, wherein the delay time associated with each of the at least first and second nozzle portions corresponds to an amount of time that it takes for the preliminary ink ejection section to move from the predetermined position to a position substantially overlapping the first and second nozzle portions, respectively.

10. The ink-jet image forming apparatus of claim 9, wherein the ink-jet image forming apparatus comprises a plurality of ink-jet heads, each having at least a first nozzle portion and a second nozzle portion.

11. The ink-jet image forming apparatus of claim 10, wherein:

each of the first and second nozzle portions is a single nozzle line or a plurality of nozzle lines of one of the plurality of ink-jet heads, and each delay time associated with each of the first and second nozzle portions of each of the plurality ink-jet heads includes a head delay time and a nozzle delay time, the head delay time being a time that it takes for a most downstream end of the preliminary ink ejection section to move from the predetermined position to a first position where the most downstream end of the preliminary ink ejection section substantially overlaps a most upstream nozzle line of the ink-jet head comprising the first and second nozzle portions, and the nozzle delay time being a time that it takes for the preliminary ink ejection section to move from the predetermined position to a second position where all of one of the first and second nozzle portions substantially overlaps the preliminary ink ejection section.

12. The ink-jet image forming apparatus of claim 11, wherein the ink ejection controller controls each of the ink-jet heads such that each of the nozzle portions begins performing preliminary ink ejection when the elapsed time, as determined by the time determining portion, becomes equal to the delay time associated therewith.

13. The ink-jet image forming apparatus of claim 12, wherein the ink ejection controller further comprises a delay determining portion, the delay determining portion determining the delay time associated with each of the plurality of ink-jet heads and each of the first and second nozzle portions of each ink-jet head.

14. The ink-jet image forming apparatus of claim 13, wherein the stored delay times associated with at least each of the ink-jet heads and the first nozzle portion and the second nozzle portion of each ink-jet head are replaced by the delay times for each of the ink-jet heads and the first nozzle portion and the second nozzle portion of each ink-jet head, as determined by the delay determining portion.

15. The ink-jet image forming apparatus of claim 14, wherein the delay determining portion determines the delay times based on a speed of the moving member.

16. The ink-jet image forming apparatus of claim 15, wherein preliminary ink ejecting time is determined based on an amount of ink which is to be ejected in order to reduce clogging of each of the plurality of ink-jet heads.

17. The ink-jet image forming apparatus of claim 14, wherein the ink ejection controller controls each of the plurality of ink-jet heads such that each nozzle line stops performing preliminary ink ejection when the elapsed time, as determined by the time determining portion, is equal to a predetermined preliminary ink ejecting time.

18. The ink-jet image forming apparatus of claim 2, wherein the ink ejection controller further comprises a distance determining portion that determines a distance that the preliminary ink ejection section has moved from a time when the preliminary ink ejection section was determined to be at the predetermined position.

19. The ink-jet image forming apparatus of claim 18, wherein the ink ejection controller controls the first nozzle portion of the ink-jet head to perform preliminary ink ejection after the ink ejection controller determines that the preliminary ink ejection section has moved a first predetermined distance from the predetermined position.

20. The ink-jet image forming apparatus of claim 19, wherein the ink ejection controller controls the second nozzle portion of the ink-jet head to perform preliminary ink ejection after the ink ejection controller determines that the preliminary ink ejection section has moved a second predetermined distance from the predetermined position.

21. The ink-jet image forming apparatus of claim 20, wherein the ink ejection controller further comprises a storage register which stores a delay distance associated with each of the at least first nozzle portion and the second nozzle portion.

22. The ink-jet image forming apparatus of claim 21, wherein the ink ejection controller further comprises a comparator which compares the delay distance associated with the first nozzle portion with the amount that the preliminary ink ejection section has traveled from the predetermined position in order to determine when to control the first nozzle portion of the ink-jet head.

23. The ink-jet image forming apparatus of claim 22, wherein when the comparator determines that the preliminary ink ejection section has traveled the delay distance associated with the first nozzle portion, the ink ejection controller controls the ink-jet head such that each nozzle line of the first nozzle portion performs preliminary ink ejection.

24. The ink-jet image forming apparatus of claim 23, wherein each nozzle portion of the ink-jet head includes a single nozzle line or a plurality of nozzle lines and the nozzle portions perform preliminary ink ejection one after another beginning with a most upstream of the nozzle portions and ending with a most downstream of the nozzle portions.

25. The ink-jet image forming apparatus of claim 24, wherein each nozzle portion is a single nozzle line and preliminary ink ejection is performed nozzle line by nozzle line from a most upstream of the nozzle lines of the ink-jet head to a most downstream of the nozzle lines of the ink-jet head such that a second most upstream nozzle line performs preliminary ink ejection after the most upstream nozzle line and a second most downstream nozzle line performs preliminary ink ejection before the most downstream nozzle line performs preliminary ink ejection.

26. The ink-jet image forming apparatus of claim 24, wherein each delay distance associated with each of the first and second nozzle portions of each ink-jet head includes a head delay distance and a nozzle delay distance, the head delay distance is a distance to be traveled by the preliminary ink ejection section in order for a most downstream end of the preliminary ink ejection section to move from the predetermined position to a first position substantially overlapping a most upstream nozzle line of the ink-jet head and the nozzle delay distance is a distance to be traveled by the preliminary ink ejection section in order for all of one of the first and second nozzle portions to substantially overlap the preliminary ink ejection section.

27. The ink-jet image forming apparatus of claim 23, wherein after the comparator determines that the preliminary ink ejection section has moved an amount equal to the delay distance associated with the first nozzle portion, the comparator determines whether the preliminary ink ejection section has moved, from the predetermined position, an amount equal to a delay distance associated with the second nozzle portion in order to determine when to control the second nozzle portion of the ink-jet head to perform preliminary ink ejection.

28. The ink-jet image forming apparatus of claim 27, wherein the ink-jet image forming apparatus comprises a plurality of ink-jet heads and each of the plurality of ink-jet heads has at least a first nozzle portion and a second nozzle portion.

29. The ink-jet image forming apparatus of claim 27, wherein the ink ejection controller further comprises a delay determining portion that determines the delay distance associated with each ink-jet head and each of the first and second nozzle portions of each ink-jet head.

30. The ink-jet image forming apparatus of claim 29, wherein the stored delay distance associated with at least each of the ink-jet head and the first and second nozzle portions of each ink-jet head are replaced by the delay distance for each of the ink-jet heads and the first and second nozzle portions of each ink-jet head, as determined by the delay determining portion.

31. The ink-jet image forming apparatus of claim 30, wherein the ink ejection controller controls each of the plurality of ink-jet heads such that each nozzle line stops performing preliminary ink ejection when the traveled distance of the preliminary ink ejection section, from the predetermined position, as determined by the delay determining portion, is equal to a predetermined distance.

32. The ink-jet image forming apparatus of claim 1, wherein the moving member moves the recording medium from a most upstream position to a most downstream position and the first nozzle portion is located upstream relative to the second nozzle portion.

33. The ink-jet image forming apparatus of claim 1, wherein the first nozzle portion is a first nozzle line of the ink-jet head and the second nozzle portion is another nozzle line of the ink-jet head.

34. The ink-jet image forming apparatus of claim 1, wherein the first nozzle portion is a plurality of nozzle lines of the ink-jet head and the second nozzle portion is a plurality of other nozzle lines of the ink-jet head.

35. The ink-jet image forming apparatus of claim 1, wherein when the first nozzle portion is performing printing ink ejection, the second nozzle portion is performing preliminary ink ejection.

36. The ink-jet image forming apparatus of claim 1, wherein when the second nozzle portion is performing printing ink ejection, the first nozzle portion is performing preliminary ink ejection.

37. The ink-jet image forming apparatus of claim 1, wherein each of the at least first nozzle portion and the second nozzle portion performs preliminary ink ejection at a first point in time and performs printing ink ejection a later point in time.

38. The ink-jet image forming apparatus of claim 2, wherein the position determination section is a portion of the moving member that includes a detectable marking.

39. The ink-jet image forming apparatus of claim 3, wherein the time determining portion further determines, based on a detection result of the detector, a time at which the recording medium is to be loaded onto the moving member.

40. The ink-jet image forming apparatus of claim 3, wherein the ink ejection controller controls the ink-jet head such that each nozzle portion performs preliminary ink ejection only when the a preliminary ink ejection signal is on.

41. The ink-jet image forming apparatus of claim 40, wherein a length of time that the preliminary ink ejection signal is on is based on an amount of ink to be ejected from the at least one of the first and second nozzle portions.

42. The ink-jet image forming apparatus of claim 3, wherein the time determining portion is reset each time the portion of the preliminary ink ejection section is determined to be at the predetermined position.

43. An ink-jet image forming apparatus, comprising:

ink ejecting means including at least a first ink ejection portion and a second ink ejection portion, the first ink ejection portion and the second ink ejection portion ejecting a same color ink, for ejecting ink from a single ink storage means, each of the first ink ejection portion and the second ink ejection portion performing preliminary ink ejection onto a preliminary ink ejection surface and image forming ink ejection onto a surface of a recording medium on which an image is to be formed, the preliminary ink ejection surface being a surface other than the surface of the recording medium on which the image is to be formed;

moving means for moving the preliminary ink ejection surface and the recording medium relative to the ink ejecting means; and determining means for determining when each of the first and second ink ejection portions substantially overlaps the preliminary ink ejection surface, wherein when the first ink ejection portion substantially overlaps the preliminary ink ejection surface, the first ink ejection portion, and not the second nozzle portion, performs preliminary ink ejection and subsequently, when the determining means determines that the second ink ejection portion substantially overlaps the preliminary ink ejection surface, the second ink ejection portion, and not the first nozzle portion, performs preliminary ink ejection.

44. The ink-jet image forming apparatus of claim 43, wherein when the first ink ejection portion is performing preliminary ink ejection, the second ink ejection portion is performing image forming ink ejection.

45. The ink-jet image forming apparatus of claim 43, wherein when the first ink ejection portion is performing image forming ink ejection, the second ink ejection portion is performing preliminary ink ejection.

46. The ink-jet image forming apparatus of claim 43, wherein each of the first ink ejection portion and the second ink ejection portion performs preliminary ink ejection at a first point in time and image forming ink ejection a later point in time in relation to a single printing operation.

47. A method for reducing clogging of ink in an ink-jet head comprising at least a first nozzle portion and a second nozzle portion, the first nozzle portion and the second nozzle portion ejecting a same color ink, the method comprising:

determining when a preliminary ink ejection section substantially overlaps a first nozzle portion of the ink-jet head;

ejecting ink from the first nozzle portion, and not the second nozzle portion, of the ink-jet head onto a preliminary ink ejection surface when it is determined that the first nozzle portion substantially overlaps the preliminary ink ejection section, the preliminary ink ejection surface being a surface other than a surface of a recording medium on which an image is to be formed; and subsequently ejecting ink from a second nozzle portion, and not the first nozzle portion, of the ink-jet head onto the preliminary ink ejection surface when the second nozzle portion substantially overlaps the preliminary ink ejection section.

48. The method of claim 47, wherein determining comprises detecting a mark in order to determine a position of the preliminary ink ejection section.

49. The method of claim 48, wherein determining comprises measuring a time that has elapsed from a time when the preliminary ink ejection section was at a predetermined position based on the detected position.

50. The method of claim 48, wherein ejecting ink comprises controlling the first nozzle portion to perform preliminary ink ejection after a first predetermined amount of time has elapsed since the preliminary ink ejection section was at the predetermined position.

51. The method of claim 50, wherein subsequently ejecting ink comprises controlling the second nozzle portion to perform preliminary ink ejection after a second predetermined amount of time has elapsed since the preliminary ink ejection section was at the predetermined position.

52. The method of claim 51, wherein ejecting ink and subsequently ejecting ink comprise determining a delay time associated with each of the at least first nozzle portion and the second nozzle portion of the ink-jet head, respectively.

53. The method of claim 52, wherein determining comprises at least one of obtaining the delay time from a storage means for the at least first and second nozzle portions and determining an amount of time that it takes for at least a most downstream end of the preliminary ink ejection surface to substantially overlap one of the first and second nozzle portions such that all nozzles of the one of first and second nozzle portions substantially overlap a portion of the preliminary ink ejection surface from a most recent time when the preliminary ink ejection surface was at the predetermined position.

54. The method of claim 53, wherein ejecting ink and subsequently ejecting ink comprise controlling the at least first and second nozzle portions such that each nozzle portion stops performing preliminary ink ejection after a preliminary ink ejection time has elapsed.

55. The method of claim 48, wherein determining comprises determining a distant that the preliminary ink ejection surface has traveled since a most recent time when the preliminary ink ejection surface was at the predetermined position.

56. The method of claim 55, wherein ejecting ink comprises controlling the first nozzle portion of the ink-jet head to perform preliminary ink ejection after the preliminary ink ejection surface has traveled a first predetermined distance from the most recent time when the preliminary ink ejection surface was at the predetermined position.

57. The method of claim 56, wherein subsequently ejecting ink comprises controlling the second nozzle portion of the ink-jet head to perform preliminary ink ejection after a the preliminary ink ejection surface has traveled a second predetermined distance.

* * * * *